US009828068B2

(12) United States Patent
Bowen et al.

(10) Patent No.: US 9,828,068 B2
(45) **Date of Patent: *Nov. 28, 2017**

(54) MECHANICAL TETHER SYSTEM FOR A SUBMERSIBLE VEHICLE

(71) Applicant: Woods Hole Oceanographic Institution, Woods Hole, MA (US)

(72) Inventors: Andrew Bowen, Woods Hole, MA (US); Robert McCabe, North Falmouth, MA (US); Matthew Heintz, Woods Hole, MA (US)

(73) Assignee: Woods Hole Oceanographic Institution, Woods Hole, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/261,086

(22) Filed: Sep. 9, 2016

(65) Prior Publication Data

US 2016/0375962 A1 Dec. 29, 2016

Related U.S. Application Data

(63) Continuation of application No. 14/627,515, filed on Feb. 20, 2015, now Pat. No. 9,463,849.

(60) Provisional application No. 61/942,266, filed on Feb. 20, 2014.

(51) Int. Cl.

| | |
|---|---|
| ***B63C 7/00*** | (2006.01) |
| ***B63B 21/20*** | (2006.01) |
| ***B63G 8/00*** | (2006.01) |
| ***B63B 21/16*** | (2006.01) |

(52) U.S. Cl.

CPC ..... *B63B 21/20* (2013.01); *B63B 21/16* (2013.01); *B63G 8/001* (2013.01); *B63B 2205/00* (2013.01); *B63B 2205/02* (2013.01); *B63B 2207/02* (2013.01); *B63B 2209/00* (2013.01); *B63G 2008/002* (2013.01); *B63G 2008/007* (2013.01)

(58) Field of Classification Search

CPC ..... B63B 21/20; B63B 21/16; B63G 8/001

See application file for complete search history.

(56) References Cited

U.S. PATENT DOCUMENTS

| | | | | |
|---|---|---|---|---|
| 4,110,554 | A | 8/1978 | Moore | |
| 8,842,956 | B2 | 9/2014 | Riorden | |
| 9,463,849 | B2 * | 10/2016 | McCabe | B63B 21/20 |
| 2011/0114006 | A1 | 5/2011 | Jung | |
| 2012/0210926 | A1 | 8/2012 | Storm, Jr. et al. | |
| 2013/0062092 | A1 | 3/2013 | Hui | |

* cited by examiner

*Primary Examiner* — Stephen P Avila

(74) *Attorney, Agent, or Firm* — Goodwin Procter LLP

(57) ABSTRACT

A flexible lifting tether system for lifting a marine vehicle or object is described which is capable of significantly improving the primary characteristics of an existing cable by enhancing load-carrying capabilities (e.g. in air), modifying the tether to have altered specific gravities in water, and relieving torsional stresses when in operation.

19 Claims, 10 Drawing Sheets

MECHANICAL TETHER SYSTEM FOR A SUBMERSIBLE VEHICLE

PRIORITY

This application is a continuation of and claims the benefit of U.S. patent application Ser. No. 14/627,515, filed on Feb. 20, 2015, which claims the benefit of priority of U.S. Provisional Application No. 61/942,266, filed on Feb. 20, 2014, the disclosures of which are incorporated herein by reference in their entirety.

FIELD OF THE INVENTION

The present invention relates to the systems and methods for tethering, disposition, and retrieval of underwater vehicles and other equipment. More specifically, the invention relates to a lightweight tethering system for the securing of heavy marine vehicles and devices.

BACKGROUND OF THE INVENTION

To communicate and/or provide power between a platform such as an ocean vessel and a remotely operated vehicle (ROV) being deployed from it, a signal-carrying umbilical is often needed. Such umbilicals most often employ fiber optics or electrical conductors as signal carriers. The performance requirements to transmit data and/or power within the umbilical are often such that very light gauge materials may be used. Such materials while suitable signal carriers are generally not useful for load bearing operations.

Other tethering systems including cables, moorings, umbilicals, support harnesses, and straps are useful for lifting, disposing, operating, and securing marine equipment particularly in the ocean or large bodies of water. Used in a variety of different fields such as oceanographic research, offshore oil industries, military operations, and underwater salvage and rescue, the tethered marine equipment often includes remotely operated vehicles (ROVs), unmanned underwater vehicles (UUVs), submarines, mini submarines, observatories, and other heavy loads which may require additional reinforcement to properly support such weights.

In operation, these heavy marine loads are often lifted from a sea-, offshore-, or land-based platform such as a ship or a dock, hoisted into the air, and lowered from the platform into the body of water. In order to accomplish the deployment, operations, and recovery of the marine load, a tether system may be engaged with a retraction device such as a winch to haul in the marine load from the water. Conventional cables and tethers are often comprised of steel and as the weight of the marine load increases, so must the diameter and length of the steel cable which itself increases significantly in weight. Furthermore, the heaving up and down motions of the water produced by waves during deployment and recovery of the marine load can damage both the tether system and the attached load. Other tethering systems may utilize high strength materials such as Kevlar in the entirety of the tether; however, Kevlar tethering systems or the like are very expensive, lack flexibility, and are often limited in lifespan.

To alleviate these problems, specialized tethers or reinforced cable modifications are designed for the deployed vehicle to prevent breakage under the weight of the load and stress forces applied to the tether. Many conventional tethers may be designed to handle the weight of the load, but may not be properly equipped to manage the torsional forces induced by the operation of the marine load, resulting in undesired hocking or twists in the tether. Individually modified setups for each marine load can be fairly expensive and may not be suitable for all operations. Furthermore, the addition of more modifications and supports add significant weight to the cable which may not be conducive to the operation of the marine load.

Incorporation of signaling—(including power—) carrying capability into complex load bearing marine tethers both complicates the tether design and the expense of tether design manufacture and operation. Therefore, there exists a need for a lightweight adaptable lifting tether system which can not only be easily adapted to lift, dispose, and retrieve a plurality of marine vehicles and equipment but fits the power and communication needs of the marine load. Such an adaptable tether would also need to be capable of relieving torsional forces to prevent damage and breakage of the tether system and/or signaling capability.

SUMMARY OF THE INVENTION

A flexible marine tether comprising a segmented line comprising a lifting segment adapted to support a marine load in air and a connecting segment mechanically engaged with the lifting segment, a terminal engagement means proximate a proximal end of the tether and a proximal end of the connecting segment, a marine load engagement means proximate a distal end of the tether, and a winch engagement means proximate a proximal end of the lifting segment is adapted to support the marine load in air when the winch engagement means is suitably engaged with a winch and may optionally connect to the terminal engagement means to transfer communication and/or power to the marine load.

The lifting segment is mechanically engaged with the connecting segment via at least one of an end-to-end connection and a threaded connection wherein the mechanical engagement is capable of providing communication and data signaling to the marine load.

The proximal end of the connecting segment is adapted to engage with the winch and the terminal engagement means, a distal end of the lifting segment is adapted to engage the marine load engagement means to attach a marine load, and a distal end of the connecting segment is adapted to be mechanically engaged with at least one of the proximal end of the lifting segment and the marine load.

The proximal end of the lifting segment is adapted to engage with a winch via the winch engagement means, the proximal end of the connecting segment is adapted to engage the terminal engagement means, and the distal end of the tether is adapted to mechanically engage the marine load engagement means to attach the marine load.

The marine load engagement means comprises a load connecting device comprising means to attach the marine load and a torsional stress relief member, wherein the load connecting device is adapted to interact with the torsional stress relief member to relieve torsional forces on the tether.

The lifting segment further comprises a lifting sleeve, a variable buoyancy mechanism integral with the lifting sleeve, and a central core with at least one line, wherein the at least one line is encompassed by the variable buoyancy mechanism.

The variable buoyancy mechanism comprises at least one of variable densities per unit length and variable buoyant density beads to create regions of varying levels of buoyant density along a length of the lifting segment.

The variable buoyancy mechanism further comprises a first region comprising at least one of a first material having a first density and/or a first set of weighted beads, the first region having a first buoyancy, a second region comprising at least one of a second material having a second density lesser than the first density and/or a second set of weighted beads, the second region having a second buoyancy greater than the first buoyancy, and a third region comprising at least one of a third material having a third density less than the first density and the second density and a third set of a third density and/or weighted beads, the third region having a third buoyancy greater than the first buoyancy and the second buoyancy.

The first set of weighted beads comprises foam beads, the second set of weighted beads comprises plastic beads, and the third set of weighted beads comprises metal beads.

The regions of varying levels of buoyant density define an S-tether.

The marine load is selected from a group consisting of a marine vehicle, a marine sampler, a marine sensor, a sensor array, a sled, a weapon, defense system, a salvaged object, a flotation device, a mooring, a buoy, and combinations thereof.

The marine vehicle is selected from a group consisting of a remotely operated vehicle (ROV), an hybrid remotely operated vehicle (HROV), an unmanned underwater vehicle (UUV), a human occupied vehicle (HOV), a glider, sled, a mini submarine, a submarine, and combinations thereof.

The connecting segment comprises at least one cable selected from a group consisting of steel cable, liquid crystal fiber cable, aramid fiber cable, polyethylene fiber cable, glass fiber cable, copper cable, optical fiber cable, power cable, carbon fiber cable, plastic cable, and combinations thereof.

The lifting segment comprises at least one cable selected from the group consisting of steel cable, liquid crystal fiber cable, aramid fiber cable, polyethylene fiber cable, glass fiber cable, copper cable, optical fiber cable, power cable, carbon fiber cable, plastic cable, and combinations thereof.

The flexible marine tether further comprises a sensor attached to the tether.

BRIEF DESCRIPTION OF THE DRAWINGS

Any dimensions included in the Figures are included solely for exemplary purposes, and different dimensions, both greater and smaller, can be used.

DETAILED DESCRIPTION OF THE INVENTION

Figure 1:
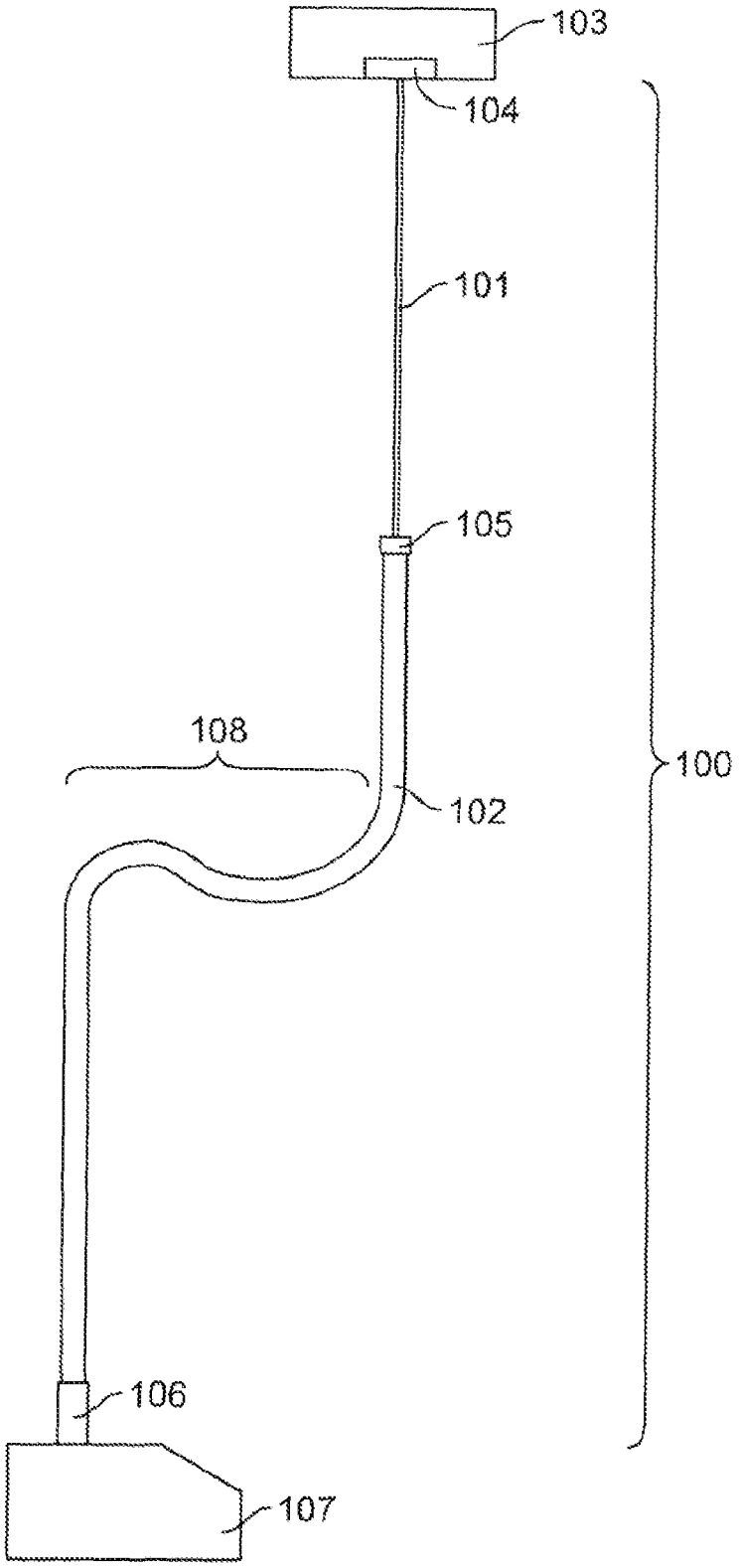
FIG. 1. Depiction of the lifting tether system wherein the distal end of the connecting segment mechanically engages with the proximal end of the lifting segment in an end-to-end connection and the two segments including electrical and optical communications may be spliced together.

Unless otherwise defined herein, scientific and technical terms used in this application shall have the meanings that are commonly understood by those of ordinary skill in the art. Generally, the nomenclature and terminology used in connection with, and techniques of, engineering, mechanical engineering, oceanography, and other related fields, described herein, are those well-known and commonly used in the art.

The term "including" is used to mean "including but not limited to," "including," and "including but not limited to" are used interchangeably.

Furthermore, throughout the specification, the terms "tether," "lifting tether system," "lifting tether," and "tether system" are used interchangeably and may be defined as the system comprising the segmented line, the winch engagement means, and the marine load engagement means to mechanically engage a marine load to a retraction device for deployment, operation, and retrieval of the marine load. These terms are distinguished and distinct form the "lifting segment," "lifting cable," or "lifting sleeve" which are sub-components of the entire tether.

The terms "line" and "cable" are used interchangeably and refer to the components of the tether system, as distinguished from the entire tether.

The term "segmented line" refers to a cable comprised of at least two mechanically engaged cables.

The term "mechanically engaged" or "mechanically coupled" as used herein refers to a connection, attachment, or interaction enabled by any number of connectors (e.g. end-to-end connection, threaded connection, contact) wherein in some embodiments the mechanical engagement refers to a terminal connection between two interfaces (e.g. connecting segment-lifting segment, lifting segment-marine load, connecting segment-marine load connecting segment-terminal engagement means). In some embodiments, a mechanical engaged connection may be established by screws, bolts, clamps, plugging in, fasteners, seals, welds, fusions, or the like known in the art.

The term "end-to-end" connection refers to a mechanical engagement wherein one end of a cable is directly attached to the end of another cable. A mechanical connector and/or engagement means is generally used to support the connection. Any signaling or power carrying means present within the cable are also kept continuous and functional across the connection.

The term "threaded" refers to the passing of a cable or line through the core (e.g. hose, tube, open center of a cable, internal cavity, or the like) of another cable. In some cases, the cable threaded through the core of another cable remains free to rotate within the core while other cases restrict the rotational movement of the cable within the core.

The term "marine" used herein refers to relating or pertaining to a body of water wherein this water made be salt water, brackish water, or fresh water unless otherwise defined. Also within the meaning of this term are systems and vessels designed to mimic the marine environment such as tanks, test tanks, pools, chambers, and the like meant to hold water and where the use of the inventive tether system is beneficial in managing the movement and retrieval of marine loads.

The term "proximal" or "proximal end" refers to the site situated toward the platform and origin of attachment of the lifting tether system, wherein the origin of attachment is the connection to the retraction device (e.g. winch) of the surface entity and optionally the connection of the tether system to the terminal engagement means.

The term "distal" or "distal end" refers to the site situated away from the platform and origin of attachment of the lifting tether system, such as the end of the tether attached to the marine load.

The term "terminal engagement means" refers to the point of attachment on the surface entity wherein the tether may engage with the winch for retrieval and may engage with surface components and sources for communication, power, and data transfer. In some cases, the communication, power, and/or data signal transfer is established by plugging into the front, back, or side of the terminal engagement means in a method known to those in the art to connect signaling means.

The term "winch engagement means" refers to the proximal end of the lifting segment where upon suitable contact with the winch or other retraction device allows the lifting tether to comprise enhanced lifting capabilities (e.g. in air).

The term "marine load engagement means" refers to the point of attachment on the marine load to the tether wherein the point bears and supports at least the desired weight of the marine load and allows the marine load to rotate about the tether and release torsion. In some embodiments, the marine load engagement means also provides the connection and passage of signals (e.g. communication, power, data) from the tether system to the marine load.

The term "connecting segment" refers to a lightweight cable which attaches to the winch and through the terminal engagement means and establishes the connection for communication and power. In conjunction with the lifting segment, the connecting segment assists the retrieval of the marine load wherein this connecting cable alone is incapable of supporting the full weight of the marine load in the air. Generally, the proximal end of the connecting segment attaches to the winch and/or terminal engagement means and the distal end may mechanically engage with the lifting segment or with the marine load.

The term "lifting segment" refers to the high strength, lightweight, load-bearing means which comprises a lifting sleeve with a variable buoyancy mechanism, a central core most often comprising at least one cable, and a winch engagement means wherein the lifting segment must contact the retraction device to supplement the load-bearing capacity of the tether. In general, the proximal end of the lifting segment contacts the winch by the winch engagement means or mechanically engages the connecting segment; the distal end of the lifting segment may mechanically engage with the marine load or with the connecting segment.

The term "lifting sleeve" refers to a high strength component of the lifting segment which when engaged with a distal marine load and a proximal winch engagement means in suitable contact with a winch provides the strength for the lifting segment to support the weight of a marine load.

The term "S-tether" refers to the S-shape or at least a non-linear shape of the lifting segment when in water resulting from the changes in specific gravity disposed at specific regions of the lifting segment to transfer torsional forces on the tether and decouple the movements of the marine load from the surface entity and vice versa. In some embodiments, the S-tether is formed when a distal portion of the lifting segment is at a shallower depth than a more proximal portion.

The term "buoyant density" refers to the ability of a substance to float in a medium (e.g. water).

The term "winch" is used interchangeably with "retraction means" and "retraction device" and refers to the mechanism employed to retrieve the disposed marine load from the surface entity.

The lifting tether system 100 comprises a high strength lifting segment 102 through which a signal-carrying line 101 (e.g. fiber optic or electrical conductor) is passed or connects to and provides both a communication means and a mechanical support for the launch and recovery of an underwater vehicle or object 107 (i.e. marine load) of a desired weight. The inventive lifting tether system 100 allows torsional forces present within the cable to be transmitted through an "S-tether" design 108 in the tether 100 to a torsional stress relief member 113 attached to the marine load 107 when the marine load 107 rotates or moves in any suitable orientation.

More specifically, the lifting tether system 100 and methods described herein include a tether which comprises a proximal end engaged with or capable of engaging with a winch 103 and/or a terminal for connecting to signaling devices 104 on a surface entity or platform such as a vessel or land station and a distal end capable of mechanical engagement to the marine load 107. During operation, the proximal end of the lifting tether 100 attaches to a winch or other suitable retraction device 103 as the means to dispose and/or haul in the marine load 107 through air (e.g. over the side of a surface entity) between the surface entity and the water). This system 100 has particular utility in operation with marine vehicles such as remotely operated vehicles (ROVs) and unmanned underwater vehicles (UUVs) for underwater operation but may be easily adapted to a wide range of heavy loads in the marine or aquatic environment.

The inventive lifting tether 100 is comprised of a segmented line of which includes a connecting segment cable 101 and a lifting segment cable 102 mechanically engaged to constitute the entire lifting tether 100. The connecting cable 101 alone does not generally comprise the tensile strength to support the weight of a marine load 107 and rather is a lighter weight signal-carrying line completing the connection of the marine load 107 to a retraction device 103 and terminal for signaling device (i.e. terminal engagement means 104). The lifting segment 102, comprising a lifting sleeve 109 integrated with the lifting segment 102, is mechanically engaged with the connecting segment 101 and enhances the overall strength capabilities of lifting tether system 100. In some embodiments, the connecting segment 101 is mechanically engages with the lifting segment 102 (e.g. through or with of the winch engagement means 105). In general, the winch engagement means 105 contacts the winch wherein the lifting segment 102 may support the entire weight of the marine load 107 after the unsupported portion of the connecting means 101 has been fully retracted into the winch drum or other retraction device 103.

The lifting sleeve 109 is a load-bearing member built around a central core 111 wherein the core 111 may be hollow or of a solid composition, and the design of the core 111 is suitable for accommodating one or more communication lines (e.g. fiber optic, data), a power line, and/or a connecting segment 101. In most instances, the lifting segment core will be of a hollow composition to allow the passing of other lines through the center 111 of the lifting sleeve 109 down to the distal end of the tether 100 attached to the marine load 107. The ability to thread one or more cables through the tether 100 provides adaptability in design including adding power supply, communication, signaling, tracking, maneuverability, and other capabilities down to the marine load 107. In the case of a solid lifting sleeve core 111, the internal material of the core 111 may further supplement the strength capabilities of the entire tether 100.

Other benefits of the inventive tether system 100 include the easy augmentation of existing cables and available equipment with minimal modification to engage with the lifting tether system 100 to lift larger and/or heavier loads 107 into and out of the water (e.g. by end-to-end attachment). In some embodiments, the lifting segment 102 may be designed to slide over or fit to existing cables to further add tensile strength. In other embodiments, the lifting segment 102 may be mechanically engaged with existing cables for enhanced capabilities.

In some embodiments, an innovative variable buoyancy mechanism 110 is integrated into the lifting segment 102 which allows the tether 100 to vary in specific gravity (e.g. density, buoyancy, buoyant density) along specified regions of the lifting segment 102. In many cases, the specific gravities of the lifting segment 102 are altered to promote an "S-tether" 108 configuration following the deployment of the tether 100 such that when slack is present in the tether 100, the lifting segment 102 bends or curves to effectively release tension and torsion forces, preventing hocking or twist damage to the lifting tether 100 itself. In some regions, the lifting segment 102 contains materials to lower the specific gravity (i.e. add buoyancy) relative to the rest of the segment. Other regions are fabricated to include weighted materials to increase the specific gravity (i.e. reduce buoyancy) while still other regions are designed to be neutrally buoyant with respect to the lifting segment 102. Therefore, desired flotation or submergence characteristics may be achieved with the variable buoyancy mechanism 110 and incorporated into the load-bearing member (i.e. lifting sleeve 109) of the lifting segment 102.

In addition to the tether system's 100 enhanced lifting capabilities, the tether 100 is also designed to relieve torsional forces present and created in the tether in operation. In some embodiments, the lifting segment 102 of the tether 100 mechanically engages with a marine load engagement means 106 to attach the marine load 107 to the lifting tether 100. At the marine load engagement means 106, a load connecting device 112 mechanically connects the tether 100 to the marine load 107; the load connecting device 112 comprises a suitable swivel mechanism referred to as the torsional stress relief member 113 as a means to allow movement or rotation of the marine load 107 in any suitable orientation relative to the tether and release twists or hocking in the cable or in the tether 100 during operation.

In some embodiments, sensor or location-determining devices 119 are applied to or integrated on the outer periphery of the tether 100 or incorporated within. Such devices 119 are adapted to detect certain parameters (e.g. geographical coordinates, depth, temperature, pressure, motion, etc.) and relay data to the marine load 107 and/or vessel or other desired location. Optionally, a plurality of such devices 119 may be attached or embedded throughout the length of the lifting tether 100, providing data on relative location, depth, pressure, temperature, current speed, and/or other desired parameters.

Lifting Tether System Assembly

The lifting tether system 100 is comprised of a flexible tether connecting a surface platform to a marine load 107. The tether 100 is comprised of two segments, the connecting segment 101 and the lifting segment 102. The connecting segment or cable 101 is generally incapable of solely lifting, moving, and/or supporting the marine load 107 without breakage or risk of breakage. Its function is to provide a.) continuity between the platform, marine load, and the lifting segment, and in most instances, b.) to carry a signal and/or power. The lifting segment 102 is structurally able to support the weight of the marine load 107 in air, and is configured in conjunction with the connecting segment 101 to bear the weight of the marine load 107 as it passes through air.

The connecting segment 101 and the lifting segment 102 are at a minimum, mechanically engaged (e.g. connected or attached using screws, bolts, clamps, plugging in, fasteners, seals, welds, fusions, threaded or the like known in the art) which may be accomplished by different means. In some embodiments, the distal end of the connecting segment 101 and the proximal end of the lifting segment 102 are directly attached at the point of the winch engagement means 105, creating a two segment cable interface. In other embodiments, the connecting segment cable 101 is threaded through the lifting segment 102. At all times while in use, the tether 100 provides a continuous signal-carrying path between the surface entity (or platform) and the marine load 107.

Several configurations of the lifting tether system 100 are contemplated depending on the available equipment or desired mode of use. In most instances, the proximal end of the connecting segment 101 is the same as the proximal end of the tether 100 and connects to the winch or suitable retraction device 103 of the platform through the terminal engagement means 104. In some embodiments, the proximal end of the connecting segment 101 attaches to the winch 103 at the terminal engagement means 104 while the connecting segment's distal end 101 mechanically engages the proximal end of the lifting segment 102 at the winch engagement means 105 (i.e. by an end-to-end connection); the distal end of the lifting segment 102 is mechanically coupled to the marine load 107 by way of the marine load engagement means 106 (FIG. 1).

Figure 2:
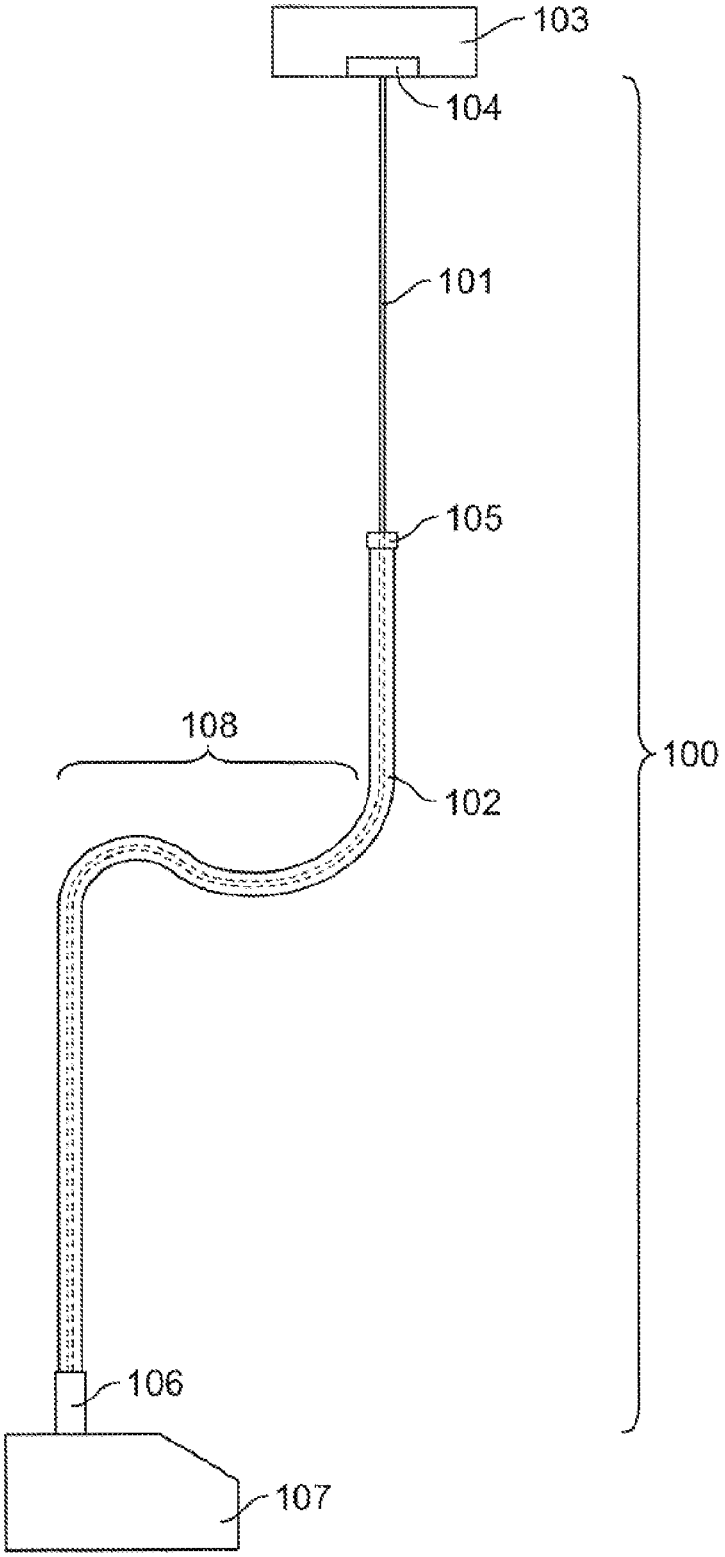
FIG. 2. Depiction of the lifting tether system in which the connecting segment is threaded through the central core of the lifting segment and mechanically engages with the marine load and may deliver the electrical and optical communications.

In another embodiment (FIG. 2), the proximal end of the connecting segment 101 is attached to the winch 103 at the terminal engagement means 104 with the distal end of the connecting segment 101 threading through the lifting segment 102, and the distal ends of both the connecting segment 101 and the lifting segment 102 reach and/or engage the marine load 107 at the marine load engagement means 106.

Figure 3:
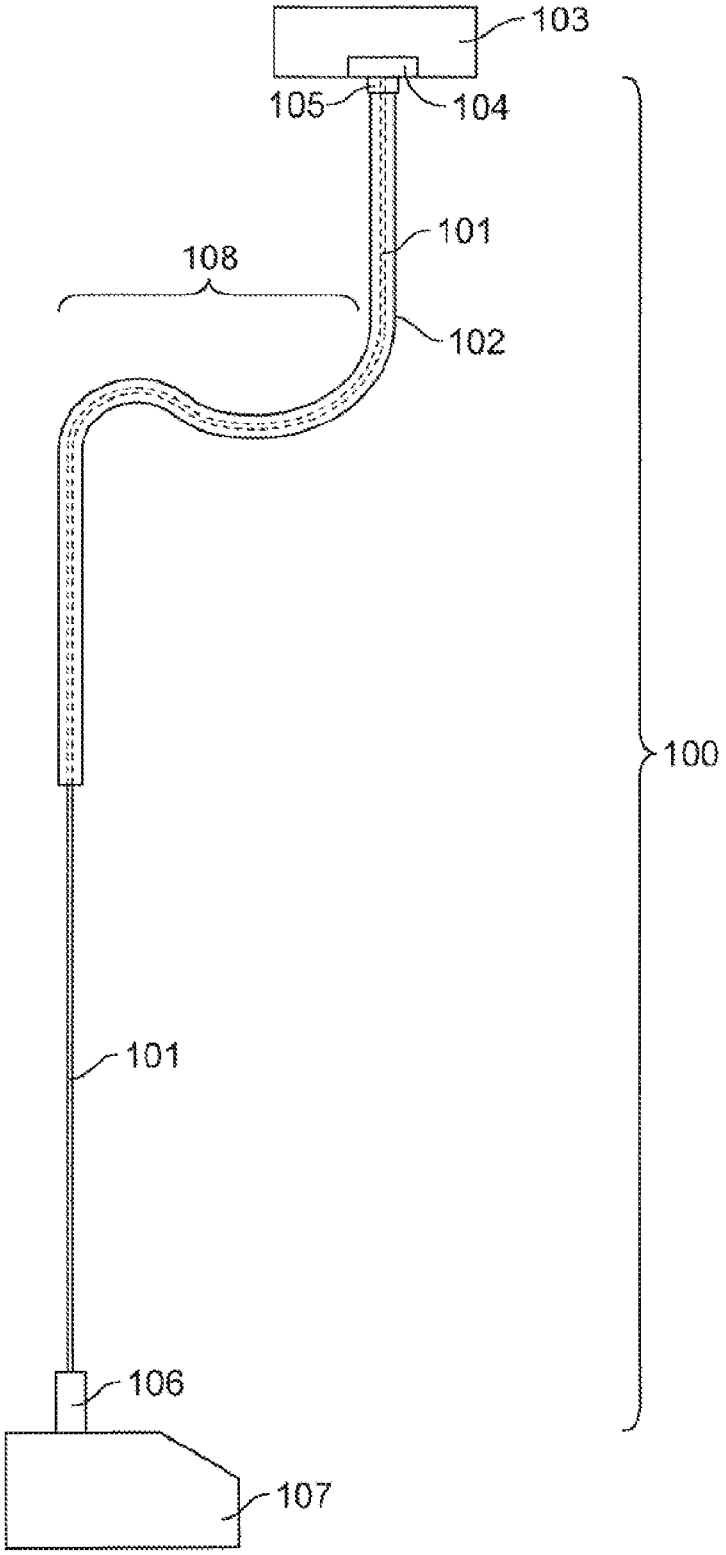
FIG. 3. Depiction of the lifting tether system wherein the proximal end of the lifting segment is engaged with the winch contacting at the winch engagement means, and the connecting segment is threaded through the lifting segment and mechanically engages with the marine load and may deliver the electrical and optical communications.

In still another embodiment (FIG. 3), the proximal ends of both the connecting segment 101 and the lifting segment 102 are disposed at the proximal end of the tether system 100 wherein the proximal end of the connecting segment 101 engages with the terminal engagement means 104, and the proximal end of the lifting segment 102 comprising the winch engagement means 105 is in suitable contact with the winch 103 ready to bear the heavy weight of the marine object 107. The distal end of the connecting segment 101 is threaded through the lifting segment 102 to connect with the marine load engagement means 106. In such cases, the retrieval of the marine load 107 is performed by engaging the winch 103 to wind the connecting segment 101 onto the winch drum 103, which pulls the connecting segment 101 through the lifting segment 102 until the marine load 107 contacts the distal end of the lifting segment 102 and establishes a mechanical connection with the lifting segment by means of an auto-latch device on the distal end of the lifting segment 102 such as is known to practitioners, wherein both segments are then wound upon the winch drum 103 as a single strand and the marine load 107 is pulled out of the water. For deployment of a marine load 107, this process is reversed, and the auto-latch device is released after the proximal end of the lifting segment 102 and the marine load 107 is adequately submerged.

Figure 4:
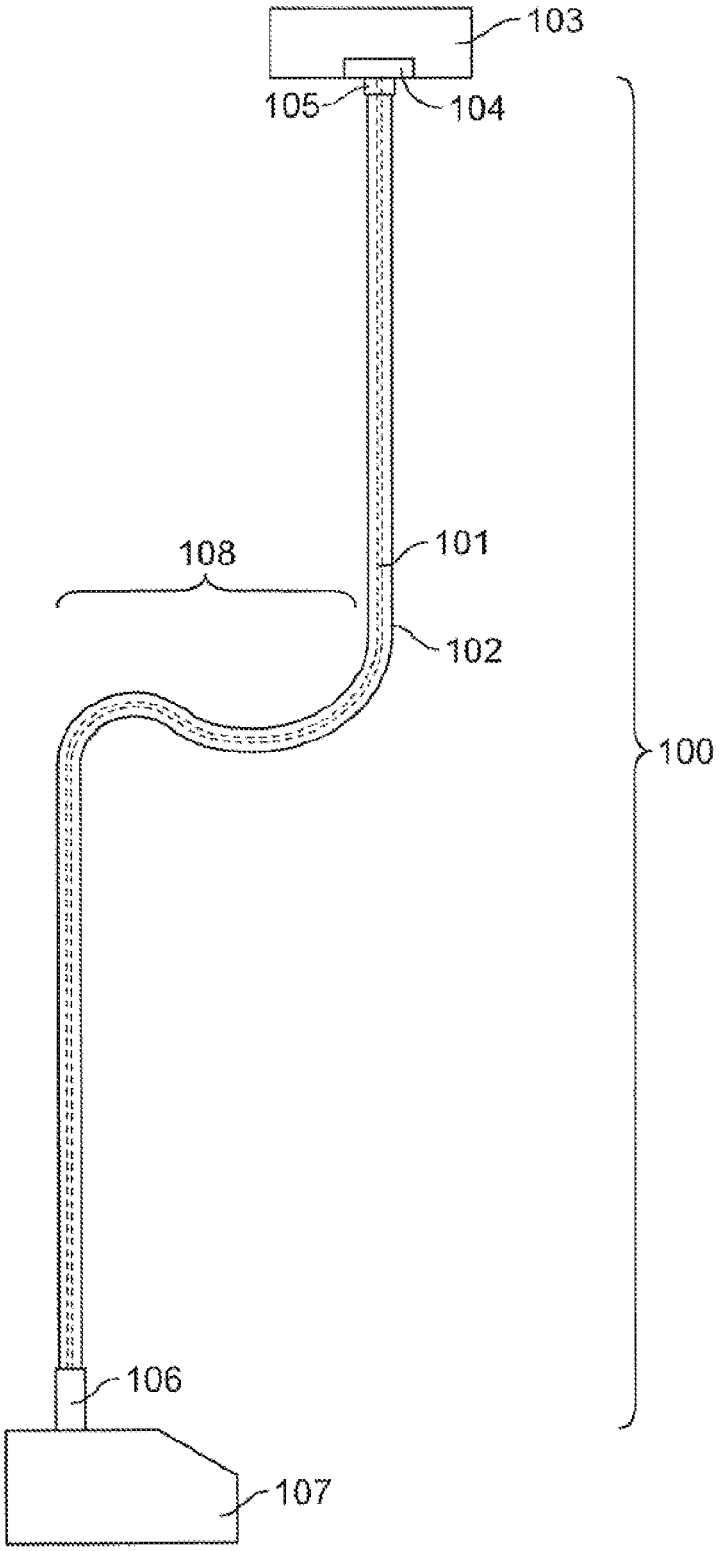
FIG. 4. Depiction of the lifting tether system in which the proximal end of the connecting segment engages with the winch and the terminal engagement means, the proximal end of the lifting segment comprising the winch engagement means is in suitable contact with the winch, and both distal ends of the connecting segment and the lifting segment are mechanically engaged with the marine load.

In some instances (FIG. 4), both the proximal ends of the connecting segment 101 and the lifting segment 102 are disposed at the proximal end of the tether 101 with the connecting segment 101 attached with the terminal engagement means 104 and the winch engagement means 105 of the lifting segment 102 in contact with the winch 103. Both the distal ends of the connecting segment 101 and the lifting segment 102 then reach and/or mechanically couple to the marine load 107.

The retrieval process of the marine load 107 by retraction uses a winch 103 or other suitable means. The lifting tether system 100 and the lifting segment 102 are largely compatible with the available devices and processes for vehicle and load retrieval. In general, the connecting segment 101 connects to the winch 103 and can be retracted thereto. However, in most instances, the connecting means 101 extends beyond the winch 103 and attaches to an optional detachable power and/or communication source via the terminal engagement means 104. As the winch begins to haul in the marine load 107, the connecting segment 101 winds around the winch drum 103 with the design of the terminal engagement means 104 either allowing the maintenance of a functional connection with the terminal signaling devices aboard the surface entity while accommodating rotation of the drum 103 or is detached before, during, or after retrieval. At a point in the retrieval, the winch engagement means 105 of the lifting segment 102 contacts the winch 103 and is retracted thereon allowing the additional strength of the lifting segment 102 to fully support the marine load 107 as it is hauled out of the water and through air. In most instances, a lack of engagement between the lifting segment 102 and the winch 103 would make the load hauling through air without breakage of the lightweight connecting segment 101 unlikely.

In those embodiments where the lifting segment 102 is end-to-end attached to the connecting segment 101 (as opposed when the connecting segment 101 is threaded through the lifting segment 102), the proximal end of the lifting segment 102 is mechanically engaged with the distal end of the connecting segment 101 (i.e. at the winch engagement means 105 of the lifting segment 102) above the beginning of the S-tether 108, and the proximal end of the connecting segment 101 is engaged with the winch 103 and the terminal engagement means 104, retrieval of the marine load 107 in this instance is accomplished by winding the portion of the connecting segment 101 around the winch 103 until the winch engagement means 105 makes suitable contact with the winch 103. At this point, the lifting sleeve 109 provides additional load-bearing capacity to the tether 100 to allow the marine load 107 to be lifted out of the water and moved to a suitable location.

In embodiments where the proximal end of the connecting segment 101 is engaged with the winch 103, and the distal end of the connecting segment 101 is threaded through the lifting segment 102, and the distal ends of both the connecting segment 101 and the lifting segment 102 mechanically engage with the marine load 107, the marine load 107 is retrieved by winding the connecting segment 101 onto the winch until the winch engagement means 105 of the lifting segment 102 contacts the winch 103 at which point, the marine load 107 may be lifted out of the water, with the entire load 107 being born by the lifting segment 102.

In other embodiments, both the proximal ends of the connecting segment 101 and the lifting segment 102 engage with the winch 103 but only the distal end of the connecting segment 101 mechanically engages with the marine load 107. In some embodiments, the connecting segment 101 is moveably threaded through the lifting segment 102, but in other cases the connecting segment 101 is not permitted to move within the lifting segment 102. Generally speaking in these embodiments, the lifting segment 102 may be retained immediately adjoining the retraction device 103 during use of the tether 100, and extends as many meters below the surface of the water as desired. The connecting segment 101 is deployed or retracted through the lifting segment 102 and may be wound upon the winch 103. During retraction, when the marine load 107 reaches the distal end of the lifting segment 102, it mechanically engages with the lifting segment 102 via a mechanical coupling present of the segment, which further activates retrieval of the lifting segment 102 onto the retraction device 103.

In still another lifting tether embodiment, the connecting segment 101 is threaded moveably or non-moveably through the lifting segment 102, and the lifting segment 102 covers the entire length of the lifting tether 100. Upon retrieval of the marine load 107, the lifting segment 102 containing the connecting segment 101 threaded within is wound upon the winch 103, and the marine load 107 may be lifted out of the water at any suitable point.

Terminal Engagement Means

The terminal engagement means 104 serves as the signal—(e.g. for communication, power, and/or data) carrying interface between the platform signal generator and the tether 100. The terminal engagement means 104 may reside directly on the retraction device 103 and serve as a connector for the connecting segment 101 or the tether 100 or may be threaded through the retraction device 103 to interface with the signal generator elsewhere. The proximal end of the connecting segment 101 is generally wound around the winch drum 103 for retrieval while still maintaining a connection with the terminal engagement means 104 for purposes of facilitating the surface entity's communication and signaling devices. In some cases, the communication, data, and/or power signal transfer is established by plugging into the front, back, or side of the terminal engagement means in a method known to those in the art to connect signaling means.

In some embodiments, the connecting segment 101 securely yet releasably engages with the terminal engagement means 104 via a connector or adaptor suitable for configuring a mechanical, electrical, and/or signal-generating means to transfer communication, data, commands, programs, etc. to the marine load 107, from the marine load 107, or in both directions.

Winch Engagement Means

Disposed at the proximal end of the lifting segment 102, the winch engagement means 105 acts as the interface to engage the winch 103 with the lifting segment 102 which when fully engaged with the winch results in an increase in the load-bearing capacity of the lifting tether system 100.

In some embodiments, the winch engagement means 105 is further comprised of a transition interface 120, which attaches the distal end of the connecting segment 101 with the proximal end of the lifting segment 102, firmly connecting to the lifting sleeve 109. Upon retrieval of the marine object, the transition interface 120 is capable of being wound up on the winch 103 as part of the winch engagement means 105. In further embodiments, the transition interface 120 may only provide an attachment interface for securing the two segments 101, 102 end-to end or may provide an interface to allow the connecting line 101 to pass through and thread into the lifting segment 102 while still securely fastening the lifting sleeve 109. In other embodiments, the transition interface 120 mechanically engages the connecting segment 101 on one side and the lifting segment 102 on the opposite side wherein the signal-generating means (i.e. conductor cores 126) are spliced within the transition interface 120.

In other embodiments, the winch engagement means 105 further comprises a splice conductor interface 121 to link electrical, optical, and/or data cables of the connecting segment 101 to the lifting segment 102 in a "plug"-like or end-to-end manner into a splice shell 122. The splice conductor interface 121 may be a fusion splice, optical fiber connector, ST (straight tip) connector, or any other suitable networking connector for facilitating communication, data, and/or power transfer. In the cases of multiple cables, each cable may be individually spliced through the splice conductor interface 121. In some embodiments, these splice connections are water-proofed. In some embodiments, the transition interface 120 is allowed to flood partially or completely with water to counter changes in tether 100 buoyancy.

Marine Load Engagement Means

Figure 6:
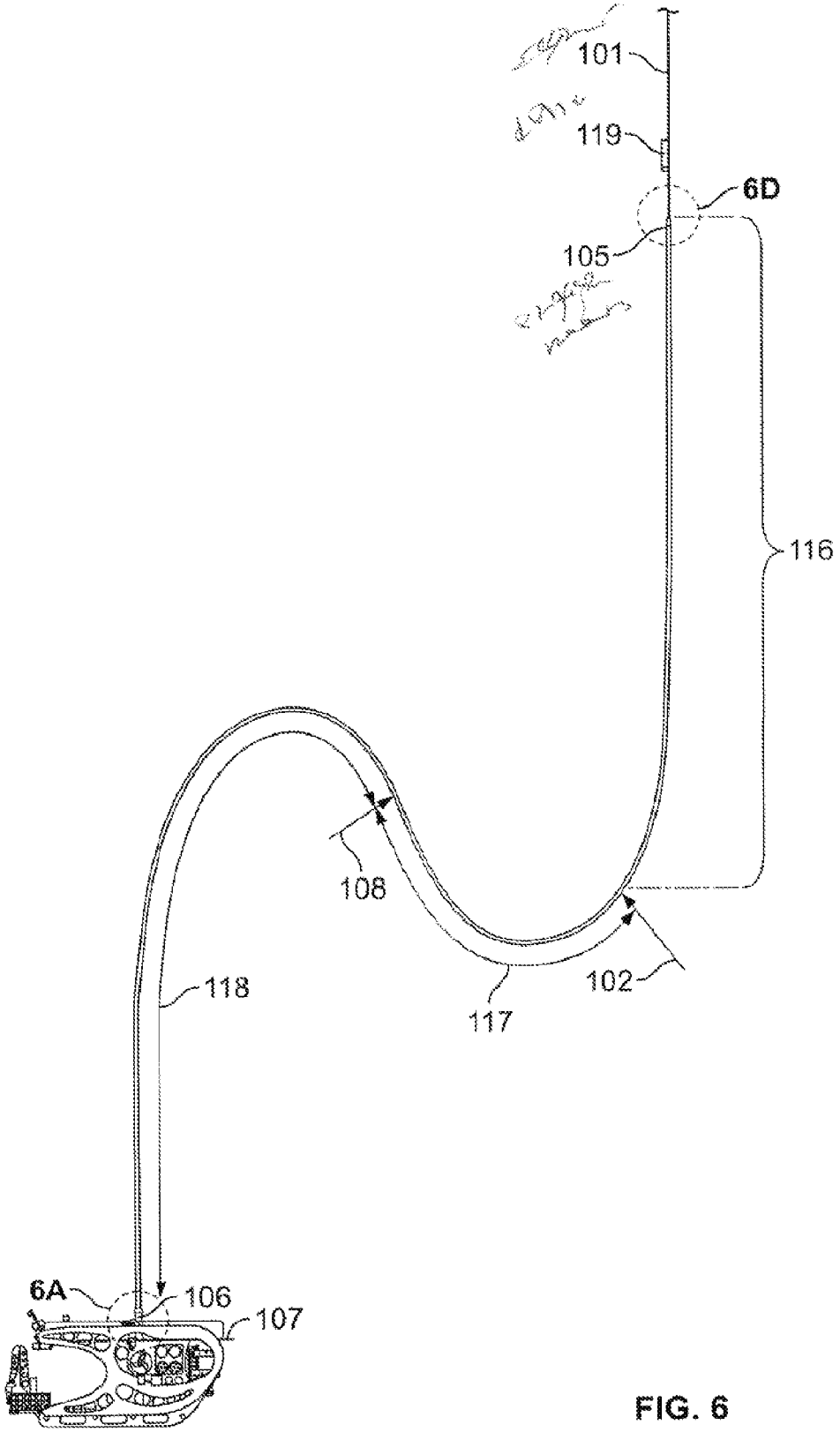
FIG. 6. Detailed embodiment of the lifting tether system. In this example, a marine vehicle is connected to the lifting tether system connected with the lifting segment utilizing a variable buoyancy mechanism altering the specific gravity of three regions of the tether creating the S-tether shape.
Figure 6A:
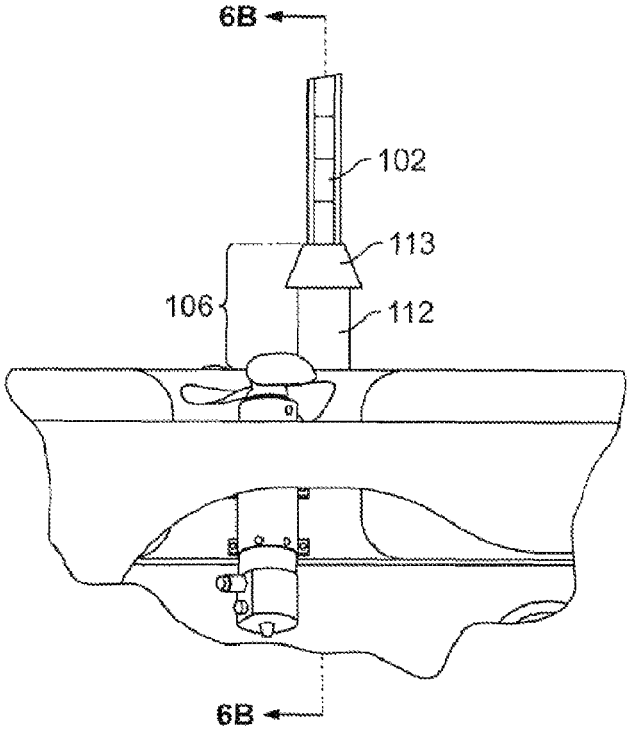
FIG. 6A. Depiction of the marine engagement means connecting the distal end of the lifting tether system to the marine load, according to one embodiment.
Figure 6B:
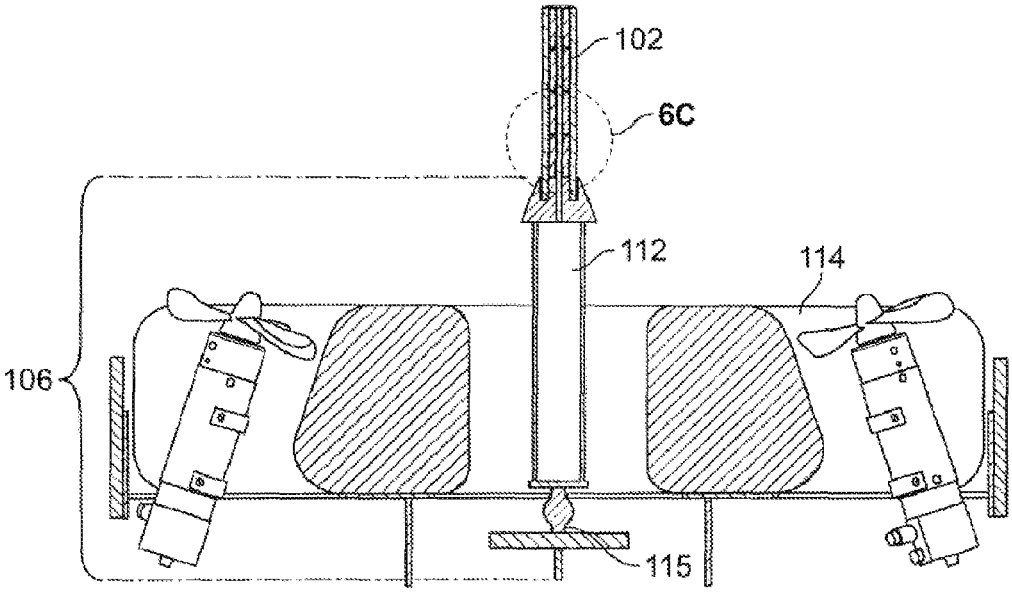
FIG. 6B. Detailed depiction of the marine engagement means connecting the distal end of the lifting tether system to the marine load by means of the load connecting device.

The marine load engagement means 106 is disposed at the distal end of the lifting tether system 100 mechanically engages and supports the marine load 107, provides source connectivity for cables from the surface entity, and transfers and releases torsional forces stored in the cables, as illustrated in FIGS. 6A and 6B according to one embodiment. The distal end of the lifting tether 100 meets and terminates at the load connecting device 112 which further connects to a swivel or other mechanical rotational means to enable rotary freedom about an axis relative to the tether 100 referred to as the torsional stress relief member 113. The load connecting device 112 latches onto the tether 100 while allowing any cables present in the central core 111 of the tether 100 to interface with the electrical and optical circuitry integrated in marine load 107 for such cases as optical signals, electrical signals, data transfer, or of the like. At the most distal end, the load connecting device 112 may attach to the marine load 107 at a universal joint 115.

Although the lifting tether 100 attaches to the marine load 107 through the load connecting means 112, some variation may occur depending on the type of marine load 107 to be secured. The particular type of attachment may also depend on the marine load's shape, size, frame, weight, and operation. In some embodiments, the tether 100 attaches to the frame 114 of the marine load 107. In such cases, the attachment is made on the surface of the marine load 107, and other cases allow attachment to be made through the frame 114 which may be more appropriate for larger and/or heavier loads to obtain an adequate attachment wherein the load connecting device 112 integrates into the marine load frame 114 and secures with the universal joint 115.

In order to facilitate communication with the surface entity, the marine load engagement means 106 comprises the suitable internal components to connect and transfer the electronic and communication signals to the marine load 107. Such components include suitable conductors, connectors, and adaptors which may be water-proofed or housed in a water-proof junction box within the load connecting device 112.

The weight forces of the lifting tether 100 is reduced at the distal end engaging with the marine load 107 by the S-tether 108, relieving tension, allowing the marine load 107 to rotate and assume any suitable orientation about the axis of the tether 100, and minimizing the potential for hockling damage.

Connecting Segment

The connecting segment 101 of the tether system 100 is a lightweight connecting cable which may engage with the winch 103 for retraction, and in many embodiments, engages with the marine load 107. More specifically, the connecting segment 101 engages with the winch 103 but in many embodiments also extends beyond to operationally attach to a signal-generating means of the terminal engagement means 104 which may include a communication, data, and/or power source. In other embodiments, the connecting segment 101 does not include signal-generating means and only provides a lightweight means to attach the lifting segment 102 and/or the marine load 107 to the retraction device 103 wherein a further attachment to the terminal engagement means 104 may not be needed in tether operation.

As the winch 103 begins to haul in the marine load 107, the proximal end of the connecting segment 101 winds around the winch drum 103 with the design of the terminal engagement means 104 maintaining a connection with the surface entity's signaling devices through the terminal engagement means 104 while accommodating rotation and winding of the drum 103. In some embodiments, the connecting segment 101 securely yet releasably engages with the terminal engagement means 104 via a connector or adaptor suitable for configuring a mechanical, electrical, and/or signal-generating means to transfer communication, data, commands, programs, etc. to the marine load 107, from the marine load 107, or in both directions. Such an attachment with the terminal engagement means 104 may need to be secure enough to withstand any sudden pulls or jerks on the connecting segment 101 to prevent disconnect of the communication with the marine load 107.

The distal end of the connecting segment 101 may engage with the proximal end of the lifting segment 102 or may engage with the marine load engagement means 106 and attach the marine load 107. Furthermore, either engagement may allow for the communication with the marine load 107. In some embodiments, the distal end of the connecting segment 101 engages with the proximal end of the lifting segment 102 via an end-to-end connection (FIG. 6D). A suitable end-to-end connection serves as an interface between the two different segments 101, 102, each segment of which often comprises distinct cable characteristics with respect to load capacity, elasticity, flexibility, etc. and is facilitated by the transition interface 120. Thus, the end-to-end connection must be capable of handling the desired loads, withstanding the retrieval and storage processes of the retraction device 103, and transferring communications with the marine load 107. In some embodiments of the end-to-end connection, a transition interface (e.g. hose, tube, shell, splice housing) is fabricated to allow the connecting segment 101 to plug into the lifting segment 102 wherein the transition interface 120 comprises internal components to facilitate the splicing of electronic fittings (e.g. conductors, electrical fittings, optical fittings, cable terminations, fiber service loops) and the transfer of communication with the marine load 107 securely from the connecting segment 101 to the lifting segment 102 (FIG. 6D). While the internal cavity of the transition interface 120 may be flooded with water when in operation to maintain the suitable buoyancy of the tether 100, the electrical components and/or splice sites may be water-proofed. Alternatively, the transition interface 120 may be partially or completely flooded with another fluid such as an antifreeze solution or other suitable solutions for colder waters as a means to prevent communication issues with the marine load 107.

In some instances of an end-to-end connection, the transition interface 120 is approximately 7 inches to 10 inches in length, but may be less than 7 inches, less than 5 inches, less than 3 inches, and sometimes less than 1 inch while still accommodating a proper connection between the two tether segments 101, 102. In cases where a more robust end-to-end connection is desired, the transition interface 120 is greater than 10 inches, 15 inches, 20 inches, 30 inches, 40 inches, or equal or greater than 50 inches in length.

Figure 6E:
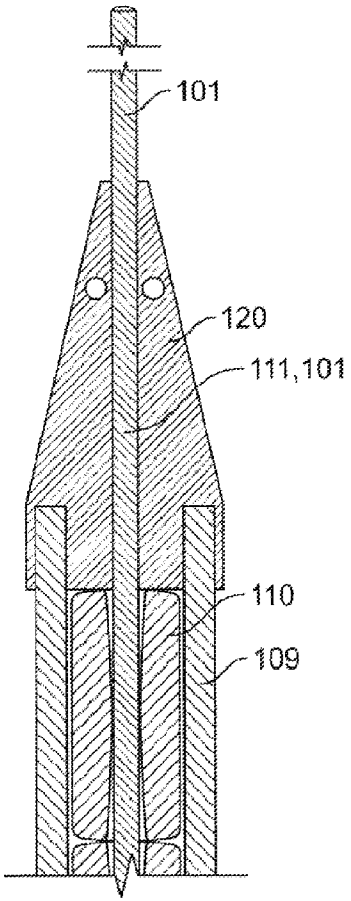
FIG. 6E. Depiction of the transition interface connecting the connecting segment to the lifting segment by means of threading the connecting segment through the transition cone and through the central core of the lifting segment, according to one embodiment.
Figure 6D:
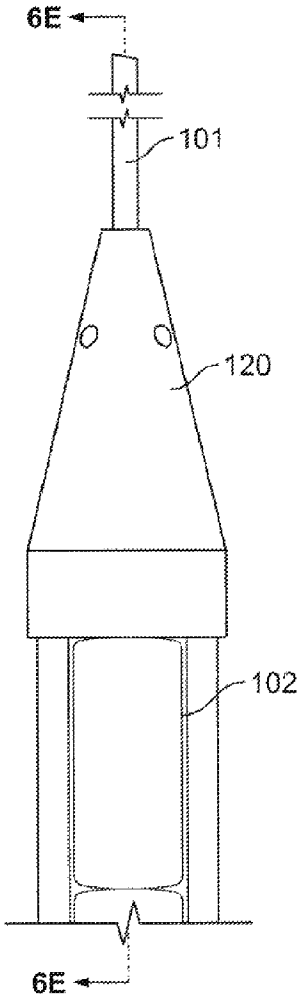
FIG. 6D. Depiction of the transition interface connecting the connecting segment to the lifting segment via an end-to-end connection, according to one embodiment.
Figure 6C:
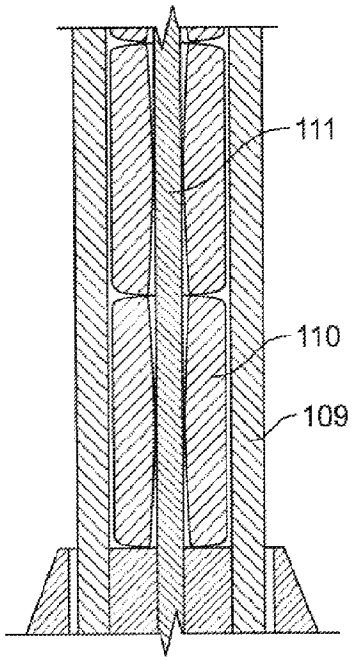
FIG. 6C. Detailed cross-section of the lifting tether system illustrating the lifting sleeve, the variable buoyancy mechanism, and the central core, according to one embodiment.

In embodiments where the connecting segment 101 engages with the marine load 107, the connecting segment 101 threads through the central core 111 of the lifting segment 102 to meet the marine load engagement means 106 (FIG. 6E). In some cases, both the connecting segment 101 and the lifting segment 102 engage the marine load engagement means 106 to attach the marine load 107; in other cases, only the connecting segment 101 secures the marine load 107, and the lifting segment 102 approaches but does not directly engage the marine load 107.

Communication is established with the marine load 107 by this interaction of the connecting segment 101 with the marine load engagement means 106 wherein the marine load engagement means 106 comprises suitable internal components to facilitate the electronic and communication integration and the transfer of communication with the marine load 107.

Cables for the connecting segment 101 which will benefit most from the inventive tether 100 are lightweight and are not capable of supporting the entire weight of the marine load 107 alone, although the lifting tether 100 may be used in conjunction with any weight or diameter cable. In some instances, the connecting cable 101 for the tether system 100 may be an existing cable previously used. In other cases, the connecting segment 101 is comprised of a plurality of cables to meet the needs of the lifting tether system 100.

In some embodiments, such cables may include either simple or reinforced cables strengthened with steel or syntactic strength members such as liquid crystal polymer fiber (Vectran), aramid fiber (Kevlar), polyethylene fiber (Spectra), or similar material. Connecting segments 101 having an electromagnetic conducting pathway such as a fiber optic pathway, an electrical metallic (e.g. copper) wire or cable, or electro-optical-mechanical cable (EOM; e.g. 0.322 CTD cable) may also benefit from the subject embodiments. Other embodiments of the connecting segment 101 include a plurality of types of cable such as wire, cord, rope, carbon fiber, glass fiber, optical fiber, polyester core, low density plastics, Kevlar core, tinned copper, steel cable, double armored steel, triple armored steel, galvanized improved plough steel, specialty steel alloys (e.g. grade 304, grade 316, nitronic-50), shielded cable, coated cable, thermoplastic covered cable. In some embodiments, more than one type of cable or line may comprise the connecting segment 101.

Any length of connecting segment 101 may be used according to the needs of the specific mission. In some embodiments, the tether assembly 100 comprises a connecting segment 101 of at least 120 meter. Other cases may utilize a shorter length of 1 m, 5 m, 10 m, 20 m, 30 m, 40 m, 50 m, 60 m, 70 m, 80 m, 90 m, or 100 m. In the cases of deeper waters, the connecting segment 101 may be at least as long as 150 m, 200 m, 500 m, 800 m, 1,000 m, and possibly up to lengths equal to or greater than 6,000 m.

Suitable cables may be of a diameter close to 2 mm, 5 mm, 10 mm, or equal or greater than 15 mm. In some embodiments, the connecting segment 101 is comprised of a cable less than 2 mm in diameter.

Lifting Segment

The lifting segment 102 enhances the tether system 100 to be capable of hauling, supporting, moving, and disposing the marine load 107 which would typically break a cable of the strength of the connecting segment 101. More particularly, the lifting segment 102 is of a strength capable of bearing heavy loads and withstanding sudden pulls and snatches which may occur in the marine environment. Unexpected changes in conditions and weather can result in increased stresses such as pitching and lurching on the surface entity and the tether system 100. Furthermore, movements from the surface entity may also cause additional forces to be exerted upon the lifting tether system 100. As conventional tethering systems have comprised higher strength yet heavy weighted cables, the lifting segment 102 of the subject invention provides similar abilities with reduced weight in addition to other benefits such as the S-tether 108, which may be greatly valuable to the deployment of a variety of marine loads 107.

The lifting segment 102 of the inventive tether system 100 may be defined as the high strength, lightweight load-bearing means which comprises a lifting sleeve 109 with a variable buoyancy mechanism 110, a central core 111 most often comprising at least one cable, and a winch engagement means 105. Furthermore, the variable buoyancy mechanism 110 in the lifting segment 102 creates an "S"-shaped or similar shaped contour (i.e. S-tether 108) in the lifting segment 102. In several instances, the distal end of the lifting segment 102 interacts with the marine load 107 via the marine load engagement means 106, and the proximal end of the lifting segment 102 contains the winch engagement means 105 for interaction with the winch 103.

In general, the lifting segment 102 will be flexible and suitable for securing a marine load 107 or other device. In many embodiments, the lifting segment 102 is built around a central core 111 (e.g. conductor core, hose, tube) surrounded by the lifting sleeve 109, and the core 111 may be hollow to allow the passing of at least one cable through to engage with the marine load 107 for power supply, communication, signaling, sensing, or simply for attachment to the marine load 107. In other embodiments, the core 111 of the lifting segment 102 is solid where additional communications through the tether 100 with the marine load 107 are unnecessary.

In addition to enhancing the strength of the overall lifting tether system 100, the lifting segment 102 manages the differences in structural and elastic stretch between the core 111, cables, and the lifting sleeve 109 of the lifting segment 102. If one of these components stretches more or stretches less than the other components, additional stress is placed on the tether 100 and may result in breakage.

Suitable lifting sleeves 109 generally cover the entire length of the lifting segment 102 and of a length from approximately 50 meters to approximately 100 meters. The specific length of the sleeve 109 may be determined by specific hauling and/or aspects and may be governed by the demands of use or specific dimensions of the surface entity. In some embodiments, the lifting sleeve 109 is less than 50 m, and is closer to 10 m, 15 m, 20 m, 30 m, or 40 m in length. In other embodiments, the lifting sleeve 109 may be longer than 100 m such as 110 m, 120 m, 130 m, 150 m, and in some cases 200 m. Other embodiments utilize a lifting sleeve 109 of a length longer than 200 m or even 500 m.

In some embodiments, the lifting segment 102 may be slid over the connecting segment 101 wherein the connecting segment 101 is threaded through the central core 111 of the lifting segment 102 to enhance the lifting abilities of an existing cable 101. Such embodiments of the lifting segment 102 serve to augment the strength of available tethers. In such cases, the lifting segment 102 may be positioned over the distal 50 to 100 meters or more of the connecting segment 101 at or near the junction 106 of the tether 100 and the marine load 107. Likewise, the lifting segment 102 may be positioned within the proximal 50 to 100 meters of the tether 100 at or near the attachment of the tether 100 with the winch 103.

As previously described, the proximal end of the lifting segment 102 may mechanically engage with the distal end of the connecting segment 101 (i.e. at the winch engagement means 105) by and end-to-end connection. In these instances, the lifting segment 102 may comprise the distal 50 to 100 meters or more of the tether 100 at or near the connection of the tether 100 and the marine load 107.

Lifting Sleeve

The central core 111 of the lifting segment 102 is surrounded by a load-bearing member referred to as the lifting sleeve 109 to construct the high strength lifting segment 102 wherein the sleeve 109 itself is suitable to assist lifting or moving a marine load 107 through a marine environment without breaking. The sleeve 109 assembly has high torsional strength (i.e. ability to withstand applied twisting/torque forces). The sleeve 109 is used for lifting the marine load 107 once contact with the winch engagement means 105 is made and several turns have been taken on the retraction device 103 winding the connecting segment 101.

The lifting sleeve 109 diameter is most often scaled to the dimensions of the tether 100/connecting segment 101 in use, as well as scaled for the incorporation of other functional components (e.g. cables, variable buoyancy mechanism). In some embodiments, the sleeve 109 may be fit to encompass the cable or cables such that adequate clearance is available around the cable to allow necessary rotation or twisting of the cable. In some embodiments, adequate clearance is available to allow for a suitable amount of lubrication, if necessary.

In most instances, the load-bearing material of the sleeve 109 is fabricated from a high strength, relatively flexible, corrosion-resistant material (e.g. plastic, thermoplastic, thermal rubber, polyurethane, foam, carbon). The tensile strength (i.e. the strength of the material to withstand the maximum stress before failing) should be adequate for lifting the weight of the marine load 109 through air. In some embodiments, the lifting sleeve 109 is comprised of a thermoplastic material. Such materials may be desired for their lightweight properties as to allow maximum variation in assembly weight as controlled by the introduction of the variable buoyancy mechanism components 110. Some embodiments involve a lifting sleeve 109 fabricated from rubber, plastic (e.g. polypropylene, polyester, polyethylene terephthalate, polyethulene, polyvinyl chloride, polyvinylidene chloride, polysterene, polyamides, acrylonitrile butadiene styrene, polycarbonate, polyurethane, polyetheretherketone, polyimide), nylon, carbon fiber, metal, graphite, or other suitable materials.

In some embodiments, the lifting sleeve 109 covers the entire length of the lifting segment 102; other embodiments utilize a lifting sleeve 109 to only partially cover the lifting segment 102. In some embodiments, the connecting segment 101 may serve as the means to slide and deliver the lifting sleeve 109 to the marine load 107 where it can be attached to the object 107 to be lifted.

S-Tether

The contoured "S" shape (e.g. curves, bends, non-linear shape) in the lifting tether system 100, referred to as the S-tether 108, is formed by the varying buoyant densities present within the lifting segment 102 as determined by the variable buoyancy mechanism 110. The S-tether 108 is used to transfer torsional forces from the tether 100 and the cables to the torsional stress relief member 113 at the junction near the marine load 107. By creating contours in the tether system 100, the horizontal and vertical motions of the marine load 107 and/or the surface entity are decoupled (i.e. have little impact on each other or no appreciable motion transmission) which removes an additional source of tension on the tether 100. By doing so, any torsion present within the tether 100 can be effectively released through the low tension S-tether 108, whereas previously such torsion would result in hocking or twist damage to the tether 100 itself. In some embodiments, the S-tether 108 is formed when a distal portion of the lifting segment 102 is at a shallower depth than a more proximal portion.

Variable Buoyancy Mechanism

Figure 5:
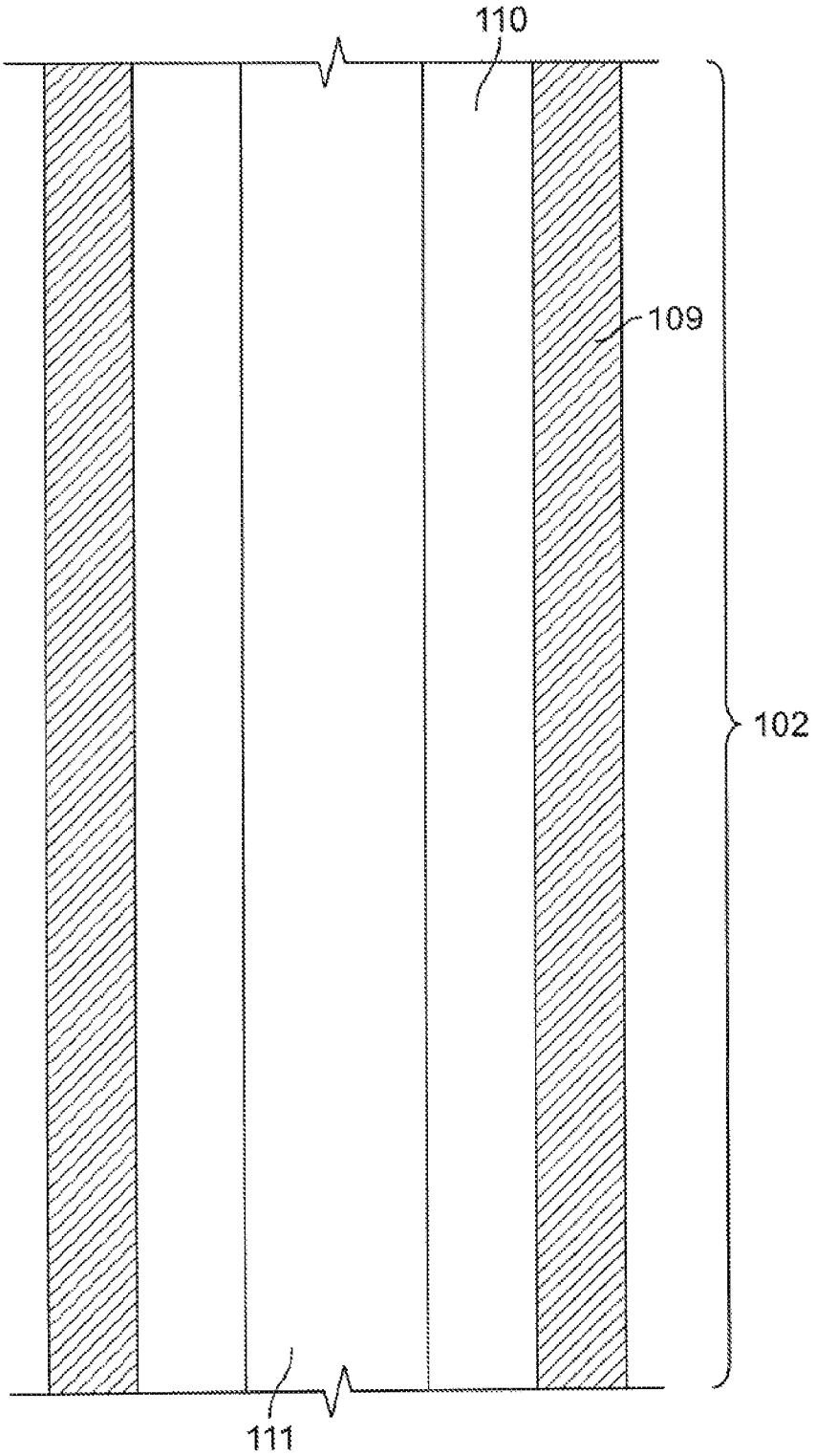
FIG. 5. Pictorial cross-section of the lifting segment depicting the lifting sleeve surrounding the variable buoyancy mechanism and the internal central core.

Aspects of the lifting segment 102 which may be modified to accommodate or enhance the utility of the tether 100 and/or lifting segment 102 and to effectively release of torsion may include changes to the specific gravities of the tether 100. Modification to the specific gravities may be accomplished by altering specific regions of the lifting sleeve 102 (FIG. 5). In many embodiments, regions of the tether 100 are modified as to create the low relief "S" shape in the tether 100 (i.e. S-tether 108).

Regions of the lifting segment 102 may be modified by means of the variable buoyancy mechanism 110. Such modifications result in weighted (e.g. sinking), neutrally buoyant, and un-weighted or floating regions disposed in the tether 100. By creating these distinct regions of different buoyancies (i.e. different specific gravities, buoyant densities) within the tether 100, specifically the lifting segment 102, torsion and stress may be relieved from the lifting tether system 100, particularly from the cables and the attachment sites of the marine load 107 and/or winch 103. Furthermore, such modifications allow the motions of the marine load 107 to be decoupled from the movements of the surface entity, thus resulting in little to no motion impact on either end.

In some instances, three or more regions of buoyancy are desired within the tether 100. In general, these regions include a least buoyant region 116, a less buoyant/neutrally buoyant region 117, and a more buoyant region 118. In one embodiment, a first least buoyant region 116 of the tether 100 is most proximally disposed near the proximal end of the lifting segment 102 to a defined length (e.g. 10 ft, 20 ft, 40 ft, 60 ft, 80 ft, 100 ft, 12 ft, 140 ft, 160 ft, equal or greater than 170 ft), and this region descends distally from the surface entity. Configuring this first region 116 to sink ensures that the lifting tether system 100 remains disposed downward and clear from the surface entity and any strong water currents present at the surface. A second less buoyant and possibly neutrally buoyant region 117 is disposed following the first region 116 which, in many instances, allows the region 117 retain a level of suspension in the water. This region 117 is often of a length of 5 ft, 10 ft, 15 ft, 20 ft, 25 ft, 30 ft, 35 ft, or equal or greater than 40 ft. A third more buoyant region 118 is disposed following the second region 117 to a defined length (e.g. 10 ft, 20 ft, 40 ft, 60 ft, 80 ft, 100 ft, 12 ft, 140 ft, 160 ft, equal or greater than 170 ft) nearing the distal end of the lifting segment 102 (i.e. near the marine load 107) such that this region 118 is floating and bears little to no weight on the marine load engagement means 106. Each region of varied buoyant density may be extended or shortened depending on the desired buoyancy and/or contours of the S-tether 108.

Such differences in buoyancy disposed throughout the length of the lifting segment 102 may result in an "S" shape in the tether 100 (i.e. S-tether 108) wherein the first proximal region 116 is weighted down, the second region 117 is or close to being neutrally buoyant, and the third distal region 118 floats.

In some embodiments, the specific gravity of the tether 100 is modified and controlled by varying buoyant densities per unit length (e.g. per unit inch, foot, meter, etc.) along the length of the lifting segment 102. This may be accomplished by including dense material such as wire into the lifting sleeve 109 as the material of the lifting sleeve 109 is often naturally buoyant. In order to modify the specific gravities per unit length of the sleeve 109, variable layers of wire encompass the central core 111 of the lifting segment 102. Regions 118 designed to be most buoyant comprise less wire (e.g. less layers, less wires), whereas regions 116 designed to be less buoyant comprise suitable layers or numbers of wire to overcome the natural buoyancy and weigh down the lifting sleeve 102. In regions of neutral buoyancy 117, the level of wire tapering is adjusted to reach a balance between the buoyancy of the lifting segment 102 and the weight of the wire layers. Thus, the level of layering or amount of wire is increased to add additional weight. In further embodiments, the variable buoyancy mechanism 110 also utilizes beads such as buoyant glass microspheres to alter the specific gravities throughout the lifting segment. Additionally, in some embodiments, other buoyant components may be added to specific regions to further modify the specific gravities of the lifting segment 102 such as floats.

In other embodiments of the variable buoyancy mechanism 110, the specific gravities of the tether 100 are modified by a mechanism involving a plurality of beads (e.g. dots, pellets, spheres, blocks, ballast beads, glass microspheres) made from materials of varying buoyancy such as plastics (e.g. polypropylene, polyethylene, polysterene), metals (e.g. steel, copper, aluminum, iron, lead, other suitable metals), syntactic flotation materials (e.g. foam), or suitable composites to achieve desired buoyancy. The first region of least buoyancy 116 may contain weighted beads within the lifting sleeve 102 such as metal beads. The second region neutrally or at least more buoyant 117 than the first region 116 may be comprised of plastic beads. The third region of most buoyancy 118 may contain buoyant beads such as foam beads or other suitable floating material.

Changes in the specific gravities of the tether regions must also take the weights and buoyant densities of the cable or cables, sleeve 109, and/or other tether components into account to achieve proper modification of the lifting segment's 102 buoyancy.

In other embodiments, no modifications are made to alter the specific gravity of the tether 100. In these instances, the lifting segment 102 is comprised of a uniform distribution of weight and specific gravity of the cable or cables and lifting sleeve 109.

Marine Load

Marine loads 107 utilizing such novel tether systems 100 may include a plurality of vehicles, belonging but not limited to, a smaller observation class, a larger work class, or a hybrid class of marine vehicles. Vehicles of the smaller observation class may include remotely operated vehicles (ROVs), hybrid remotely operated vehicles (HROVs), unmanned underwater vehicles (UUVs), gliders, towed vehicles, or other robotic vehicles. Larger work vehicles may include human occupied vehicles (HOVs), submarines, and other underwater vehicles or hybrids thereof.

The marine load 107 may be any suitable underwater vehicle, device, or load, and in certain embodiments the marine load may weigh less than 1,000 lbs, but in many circumstances, the load 107 is greater than 1,000 lbs, 2,000 lbs, 4,000 lbs, 5,000 lbs, 8,000 lbs, 10,000 lbs, 15,000 lbs, 25,000 lbs, and sometimes greater than 50,000 lbs before additional modifications need to be introduced to the lifting tether system 100.

Other marine loads and devices 107 in addition to marine vehicles may benefit from the use of the inventive tether system 100 and lifting segment 102. These objects may include, but are not limited to marine samplers (e.g. sediment, water), sleds, weapons, defense systems, salvaged objects, anchors, flotation devices, buoys, moorings, lighting and camera (e.g. optical, video) systems, or other suitable devices.

Tethered vehicles for which the tether 100 is only used for communications (e.g. optical, fiber-optic) and which carry on-board means for power generation (e.g. battery power, wave power, other means) may utilize a very lightweight and minimally load-bearing tether and are particularly well-suited for use of the inventive lifting segment 102. The invention allows the minimization of the cable load-bearing aspects so as to allow the use of a lighter weight solution than would be possible with present techniques of the art.

Surface Entity

Suitable surface entities or tethering stations include, but are not limited to, ships, vessels, land stations, offshore stations, fisheries, land-based platforms, water-based platforms, or other suitable means to dispose and retrieve the marine load 107 using the lifting tether system 100 and a retraction means 103.

Retraction Device

The retrieval process of a tethered marine load 107 by retraction is well-known in the art. In many cases, a retractor device 103 is employed. Such devices include winches, cranes, hoists, or other suitable devices capable of loading the lifting segment 102 and the lifting sleeve 109. The sleeve 109 is generally compatible with the available processes and devices for load retrieval. For example, if a winch 103 is used, the sleeve 109 is drawn up onto the winch drum 103 along with the tether 100. Accommodations may be made on the retractor device 103 to allow for the increased diameter represented by the sleeve 109 or associated members of the subject invention.

In most cases, when the marine load 107 is to be retrieved, the tether 100 can be retracted to the point where the winch engagement means 105 of the lifting sleeve 109 engages the retractor device 103, and the marine load 107 can be brought to the vicinity of the surface entity and out of the water.

Communication, Sensors, and Suitable Devices

Some operations utilize the lifting tether system 100 for more than tethering capabilities such as channels for communication, power, signaling, and data transfer in connection with the marine load 107. In some embodiments, such channels (e.g. cables) are threaded through or with the connecting segment 101, and in other cases, such channels may be adjacently adhered to the connecting segment 101. These channels and their subsequent communication devices aboard the surface entity are adapted to connect with the terminal engagement means 104 in order to transfer communication and/or information.

Cables benefiting from the inventive system 100 include hoses or lines supporting high bandwidth communications via a hard connection, such as glass fiber which may have a cross-section diameter of 250 microns to about 900 microns or any suitable size and weight. In some embodiments, high bandwidth cables transmit real-time data, video, navigation signaling, operations commands, and other digital data transfers. Lower band communications are also possible with the use of copper or other conducting cable.

Optical fibers or other communication cables may be made from any suitable material sufficiently robust to withstand signal malfunction resulting from issues such as the high pressures and possibly cold temperatures of deep waters. Other parameters of consideration include, but are not limited to, specific gravity, weight, load-bearing ability, corrosion resistance, and bandwidth capacity. Specifically, cable buoyancy and weight may affect the variable buoyancy mechanism 110 and are evaluated in terms of the marine load 107 in operation.

In some embodiments, sensors or location-determining devices 119 are attached with, integrated at any point on the outer periphery of the tether 100, or incorporated within (e.g. within the cable, within a segment 101, 102, within the lifting sleeve 109). Such devices may be adapted to detect certain parameters and relay data to the marine load 107 and/or surface entity. Optionally, a plurality of such devices 119 may be attached or embedded throughout the length of the lifting tether 100, providing data on relative location, depth, pressure, temperature, and other desired parameters. In some embodiments, one or more sensor devices 119 are secured on or in the connecting segment 101. Other embodiments contemplate fabricating one or more sensor devices 119 on or in the lifting segment 102 or on the marine load 107.

Suitable devices 119 include marine sensors (e.g. temperature, pressure, motion, moisture, conductivity, depth, light, acoustic, tracking, geographical coordinates, gaseous composition, wave conditions, dissolved oxygen, photosynthesis, respiration, nitrate, optical properties), sonar, spectrometers, actuators, seismometers, magnetometers, hydrophones, geophones, sensor arrays, marine samplers, lighting and camera (e.g. optical, video) systems, or other suitable devices.

Power Supply

In general, marine loads 107, more specifically marine vehicles, tethered via a cable utilizing the lifting sleeve may involve conventional power systems where all the energy is delivered from the surface and/or surface entity. In this case, a typical marine vehicle power system can be supported. If a lighter cable is utilized, the marine load 107 may be powered by a combination of energy sources delivered from the surface through a cable which, from time to time, may be supplemented via on-board power sources (e.g. batteries). During periods of lower power use, such systems can provide excess energy to replenish power sources. In some embodiments, the power may, or may not be, delivered by the same cable and/or source.

Example 1

The following example describes one specific embodiment of the inventive lifting tether system 100, which is included to further illustrate certain aspects and operation of the invention and is not intended to limit the scope of the invention. Any dimensions included in the referenced Figures are included solely for exemplary purposes, and different dimensions, both greater and smaller, can be used.

Overview

Figure 7:
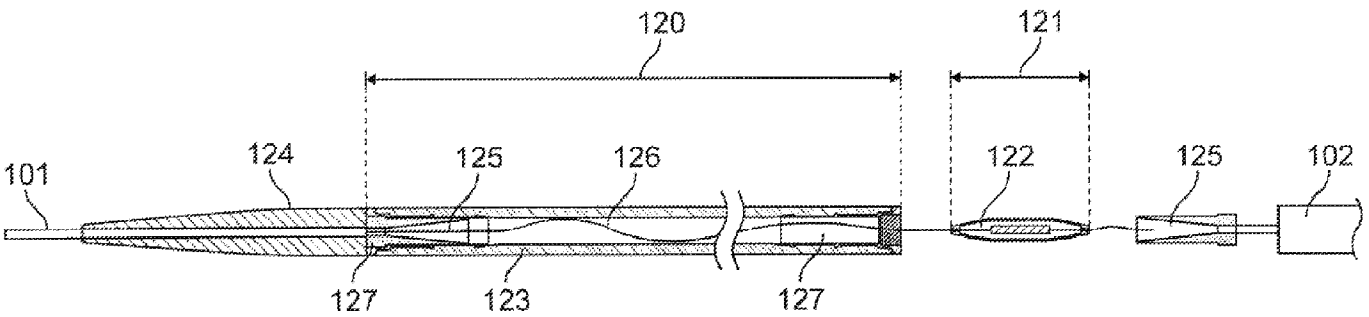
FIG. 7. Conceptual design of the end-to-end connecting segment-lifting segment cable transition interface (exploded view shown on right-hand side). The transition interface between connecting segment and lifting segment cables consists of a custom-fabricated structural termination interface hose that provides a protected internal volume to house the electrical and optical (e.g. E/O, communication, data, power) splice.

Design, fabricate, and test a novel Electro-Optical-Mechanical (EOM) Remote Operated Vehicle (ROV) lifting tether system 100 that is capable of lifting a vehicle 107 over the side into and out of the water during launch and recovery operations. This example describes an approach by which a standard steel-armored EOM cable (i.e. connecting segment 101) and a conventional strength member EOM cable (i.e. lifting segment 102) are configured to meet the desired aspects for deployment, operations, and recovery. A significant challenge is presented in the design of the connection between these two different cables, which must be able to both handle the applicable loads as well as be capable of feeding through a sheave train and onto a single drum winch 103. In particular, the presence of an optical fiber splice at this splice conductor interface 121 (creating an end-to-end connection) demonstrates a novel approach to mechanically isolate and protect this critical element of the tether system 100. The proposed approach uses a specially engineered reinforced termination interface hose 123 as part of the transition interface 120 (i.e. rubber hose, a structural hose) and a splice conductor interface 121 as a key element in this end-to-end connection as shown in FIG. 7.

Exemplary Features

The lifting tether 100 is desired to have many or all of the following characteristics:

- Incorporate a high strength, lightweight strength member section (i.e. lifting segment 102) of approximately 120 meters length
- Be capable of haul-in under a load 107, and storage, on a single-drum winch 103
- Be capable of running through multiple sheaves having a diameter of 24" and a groove diameter of 2.5"
- Interface to a lightweight connecting steel EOM cable (i.e. connecting segment 101; a 0.322 CTD cable) which is not capable of lifting the vehicle 107
- Incorporate a heavy upper section into the lifting sleeve 109 to serve as a cable depressor (i.e. region 116 of the variable buoyancy mechanism 110)
- Incorporate a lightweight buoyant lower section to assure the tether floats clear of the vehicle 107 (i.e. region 118 of the variable buoyancy mechanism)
- Interface to the vehicle 107 with an EOM termination (i.e. at the marine load engagement means 106)

Derived Specifications

- Peak dynamic working load: 15,000 lb
- Working bend radius: 12" ID (24" diameter sheave)
- Minimum rated breaking strength: 45,000 lb
- Termination and heavy section 116 bend: over 24" sheave at 3,000 lb
- Buoyant section 118 bend over sheave: 200 cycles at 7,500 lb
- Heavy section 116 wet weight: 0.5-3 lb/ft in seawater
- Buoyant section 118 wet weight: 0.15-0.5 lb/ft buoyancy in seawater
- Transition Interface 120 and termination interface hose 123 comprising a dedicated volume to house and protect delicate optical fiber splice 121

Technical Approach

Lifting Segment

The lifting segment 102 will be built around a core 111 of an EOM cable. This core 111 will consist of an Electro-Optical (E/O) conductor core with a strength member (Spectra or Vectran) and a polyurethane protective jacket (i.e. lifting sleeve 109). Heavy and lightweight layers will then be added to a 120 meter (or as needed) length of this segment 102 to construct the variable buoyancy mechanism 110 of the lifting tether 100. Heavy layers 116 may consist of multiple layers of lead ribbon or copper strand layup. Lightweight layers 118 will be formed from extruded thermoplastic rubber (TPR) and may include glass microspheres for additional buoyancy.

The lifting segment core cable 111 utilizes standard construction methods and materials, and may be purchased in bulk; depending upon the application, individual vehicle tethers 100 will be built up using the correct overall length, and the desired lengths of weighted and buoyant layers.

For the purposes of prototype fabrication and testing, a minimum economical quantity of core cable or cables 111 will be procured to allow for completion of several complete 120 m vehicle tethers as well as sufficient lengths for test sections. The prototype tethers will be built up with weighting material and buoyant extruded jacket (i.e. lifting sleeve 109).

Representative test sections from the heavy 116 and light 118 regions of the lifting segment 102 will be laboratory tested for Tension, Elongation, Torsion, and rotational stiffness (TETJ) and for Cyclic Bend Over Sheave (CBOS) performance. Successful completion of these tests will verify suitability of the lifting segment 102 against the stated features.

Transition Interface

The end-to-end connection between a connecting segment 101 and a lifting segment cable 102 consists of a custom-fabricated structural transition interface 120 comprising a termination interface hose 123 that provides a protected internal volume to house the E/O splice at the splice conductor interface 121. It is engineered and constructed to carry the tension, as well as the combination of bending and side load associated with the sheave requirements. This transition interface 120 has built-in end fittings (i.e. the conical socket termination end fittings 125, hose termination end fittings 127) that are designed to interface to the mechanical terminations for both the connecting 101 and lifting 102 cables. The transition interface 120 is vented to flood with seawater. The conductor cores 126 from both the connecting segment cable 101 and the lifting segment 102 cable are passed through the transition interface 120 with sufficient service loop to allow for ease of assembly. The electrical and optical conductors 126 are spliced and then enclosed in a hard protective shell (i.e. splice shell 122) of the splice conductor interface 121 that prevents disturbance in use. The extra conductor core slack 126 and the splice shell 122 are tucked back into the termination interface hose 123 of the transition interface 120 upon final assembly of the mechanical cable terminations into the end fittings 125, 127. A tapered urethane boot 124 is secured to the upper termination hose fitting 123 and over the connecting segment cable 101. An external cable grip may be employed over the upper end of the lifting segment cable 102 to provide bend strain relief.

The transition interface 120 comprises a termination interface hose 123 which uses standard rubber hose materials and fabrication techniques. These materials and techniques have been used for many years in the fabrication of towed sonar array hoses and oceanographic buoy mooring risers.

Figure 8:
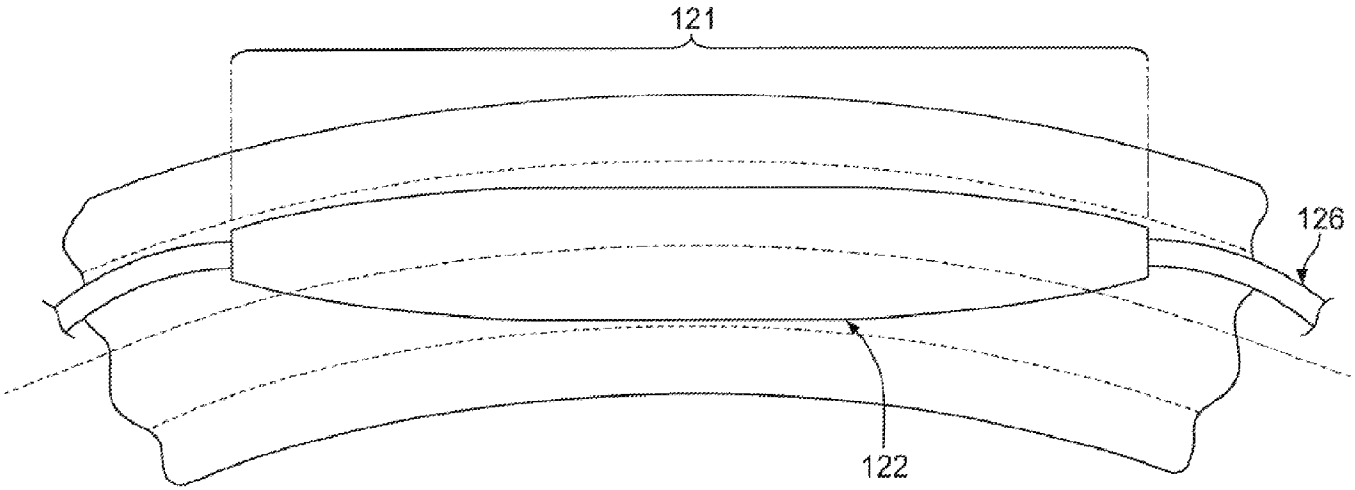
FIG. 8. The conceptual termination hose end fitting design and body dimensions are shown within the termination interface hose.

This termination interface hose 123 will use Aramid tire reinforcement cord for tensile strength, and helically wound steel wire reinforcement for crush resistance. The hose end fittings 125, 127 are built in at the time of hose manufacture and remain integral with the hose assembly for the life of the product. The detailed hose construction, termination fitting design, and the layup sequence will be established as part of this effort, and five prototype hoses of approximately 10 feet (3 meters) will be fabricated for the transition interface 120. The hose construction design may be varied during the time of the prototype builds in order to fine-tune finished properties such as hose outer diameter. The conceptual termination hose 123 design and body dimensions are shown in FIG. 8.

The termination interface hose 123 is built by laying up raw rubber and cord layers on a rotating mandrel on a lathe. The completed hoses are steam vulcanized in a special autoclave that fuses and cures the rubber material. Once vulcanized, the hoses 123 are removed from the mandrel and inspected, and are then ready for service.

Representative test hoses 123 from the prototype build will be tested for tensile properties and crush resistance in order to verify their suitability to meet the specification.

Splice Conductor Interface

Figure 9:
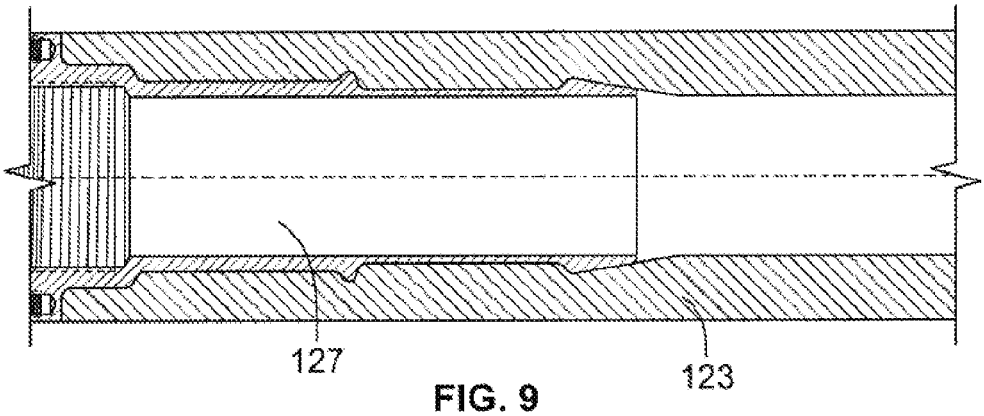
FIG. 9. The concept geometry of an electrical and optical splice interface is depicted with the conductor core cables mechanically engaging at either end through the splice shell.

The conductor cores 126 from both cables pass through the center of the transition interface 120, and sufficient slack is provided in one of the cable cores 126 to allow for an optical and electrical splice to be created at one end of the splice conductor interface 121. This splice is then secured inside the splice shell 122 of the splice conductor interface 121 that firmly holds the ends of both conductor cores 126 and provides a protected interior space for the spliced conductors 126 to remain protected. The optical splice is either a fusion splice or makes use of ST connectors—sufficient room is provided to allow for fiber service loops if desired. The electrical conductors of each core 126 are individually spliced and water-proofed. The conductor shell 122 is allowed to flood with seawater along with the center of the interface hose 123. Alternatively, if desired, the interior of the transition interface 120 and the splice conductor interface 121 may be filled with a fresh water and antifreeze mixture. The splice shell 122 of the splice conductor interface 121 is sized to fit with clearance inside the transition interface 120 when bent over a 24" diameter sheave. For a 1.25" inside diameter termination interface hose 123, the splice shell 122 is approximately 1" diameter and 7" long. The concept geometry is illustrated in FIG. 9.

Connecting Segment Cable and Lifting Segment Cable

Figure 10:
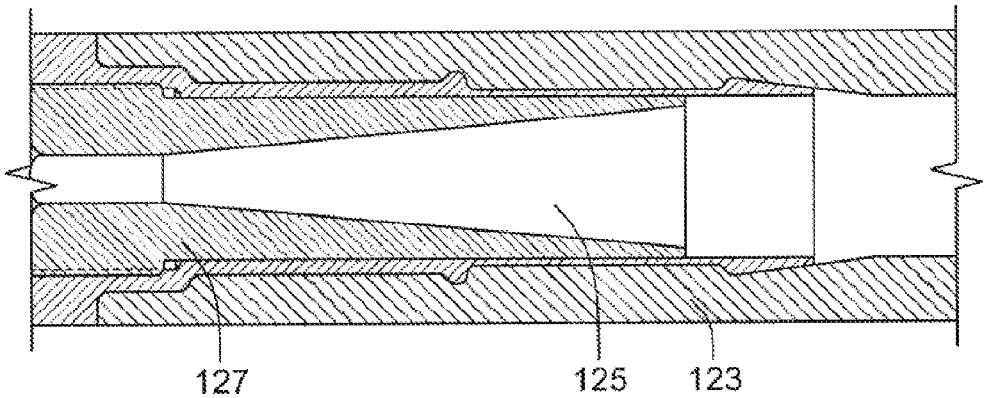
FIG. 10. Depiction of the conical socket termination within the termination hose end fitting of the termination interface hose where the connecting segment will be mechanically terminated at one end of the transition interface and the lifting segment will be mechanically terminated at the opposite end of the transition interface.

The connecting segment steel EOM cable 101 and lifting segment cable 102 will be mechanically terminated in an end-to-end connection in conical socket termination end fittings 125 using an epoxy compound as shown in FIG. 10. The conical socket termination end fittings 125 inside diameter and cone dimensions will be based on industry standard practice for the (steel or synthetic) cable termination materials and compound selected. The sockets are designed to thread into the termination interface hose end fittings 127 such that the conical socket termination end fitting 125 resides within the inside diameter of the hose end fitting, thus minimizing the length of rigid fittings to facilitate running over sheaves.

Samples of the connecting segment cable 101 and lifting segment cable 102 will be terminated and pull tested to verify the attainment of full cable break strength.

Vehicle Termination

The distal end of the tether 100 is terminated at the vehicle 107 using a standard mechanical cone or poured epoxy socket termination (i.e. the load connecting device 112 at the marine load engagement means 106). The E/O conductor core 126 is brought out the center of the mechanical termination into a junction box in the load connecting device 112 for electrical and optical integration with the vehicle 107.

Assembled Interface Hose with Connecting Segment Cable and Lifting Segment Cable Following successful manufacture and verification testing of the individual elements, an assembly will be made including a test section of both steel connecting cable 101 and lifting segment cable 102, and a termination interface hose 123 complete with electrical/optical splices and splice shell 122. This interface assembly will be subjected to a cyclic bend over sheave test representative of one year of service.

The various embodiments and features of the present invention have been described in detail with particularity. The utilities thereof can be appreciated by those skilled in the art. It should be emphasized that the above-described embodiments of the present invention merely described certain examples implementing the invention, including best mode, in order to set forth a clear understanding of the principles of the invention. Numerous changes, variations, and modifications can be made to the embodiments described herein and the underlying concepts, without departing from the spirit and scope of the principles of the invention. All such variations and modifications are intended to be included in the scope of the invention, as set forth herein. The scope of the present invention is to be defined by the claims rather than limited by the forgoing description of various preferred and alternative embodiments. Accordingly, what is desired to be secured by Letters Patent is the invention as defined and differentiated in the claims and all equivalents.

What is claimed is:

1. A tether connecting a surface entity and a marine load, the tether comprising:

a load-bearing lifting segment with a proximal winch engagement device, the lifting segment adapted to support a total weight of the marine load;

a connecting segment operatively coupled to the lifting segment and adapted to connect with a proximal terminal engagement device and support a submerged weight of the marine load; and a marine load engagement device proximate a distal end of the tether;

wherein when the winch engagement device engages a retraction device and the lifting segment engages the marine load engagement device, the tether is capable of supporting the total weight of the marine load.

2. The tether of claim 1, wherein the lifting segment engages the connecting segment via at least one of a threaded connection, such that the connecting segment passes through the lifting segment, and an end-to-end connection.

3. The tether of claim 1, wherein the marine load engagement device comprises:

a load connecting device attachable to the marine load; and a torsional stress relief member;

wherein the load connecting device is adapted to interact with the torsional stress relief member to relieve torsional forces on the tether.

4. The tether of claim 1, wherein the lifting segment comprises:

a lifting sleeve;

a variable buoyancy mechanism integral with the lifting sleeve; and a central core encompassed by the variable buoyancy mechanism.

5. The tether of claim 4, wherein the variable buoyancy mechanism comprises at least one of regions of variable buoyant densities per unit length and variable buoyant density beads disposed in the tether to create regions of varying levels of buoyant density along the length of the lifting segment.

6. The tether of claim 1, wherein the marine load is selected from the group consisting of a marine vehicle, a marine sampler, a marine sensor, a sensor array, a sled, a weapon, a defense system, a salvaged object, a flotation device, a mooring, a buoy, and any combination thereof.

7. The tether of claim 6, wherein the marine vehicle is selected from the group consisting of a remotely operated vehicle (ROV), a hybrid remotely operated vehicle (HROV), an unmanned underwater vehicle (UUV), a human occupied vehicle (HOV), a glider, a mini submarine, a submarine, and any combination thereof.

8. The tether of claim 1, wherein the connecting segment comprises at least one cable selected from the group consisting of a steel cable, a liquid crystal fiber cable, an aramid fiber cable, a polyethylene fiber cable, a glass fiber cable, a copper cable, an optical fiber cable, a power cable, a carbon fiber cable, a plastic cable, and any combination thereof.

9. The tether of claim 1, wherein the tether is connectable to the terminal engagement device to transfer at least one of communication, signals, data, and power to the marine load.

10. The tether of claim 1 further comprising a sensor attached to the tether.

11. A tether connecting a surface entity and a marine load to be lifted out of the water, comprising:

a load-bearing lifting segment;

a variable buoyancy mechanism integral with the lifting sleeve;

a winch engagement device proximate a proximal end of the lifting segment; and a marine load engagement device proximate a distal end of the tether;

wherein, when the winch engagement device is engaged with a retraction device and the marine load engagement device is attached to the marine load, the tether is adapted to support a total unit weight of the marine load.

12. The tether of claim 11 further comprising a connecting segment adapted to engage with the lifting segment via at least one of a threaded connection, such that the connecting segment passes through the lifting segment, and an end-to-end connection.

13. The tether of claim 11, wherein the marine load engagement device comprises:

a load connecting device attachable to the marine load; and a torsional stress relief member;

wherein the load connecting device is adapted to interact with the torsional stress relief member to relieve torsional forces on the tether.

14. The tether of claim 11, wherein the lifting segment comprises:

a lifting sleeve;

and a central core encompassed by the variable buoyancy mechanism.

15. The tether of claim 14, wherein the variable buoyancy mechanism comprises at least one of regions of variable buoyant densities per unit length and variable buoyant density beads disposed in the tether to create regions of varying levels of buoyant density along the length of the lifting segment.

16. The tether of claim 11, wherein the marine load is selected from the group consisting of a marine vehicle, a marine sampler, a marine sensor, a sensor array, a sled, a weapon, a defense system, a salvaged object, a flotation device, a mooring, a buoy, and any combination thereof.

17. The tether of claim 16, wherein the marine vehicle is selected from the group consisting of a remotely operated vehicle (ROV), a hybrid remotely operated vehicle (HROV), an unmanned underwater vehicle (UUV), a human occupied vehicle (HOV), a glider, a mini submarine, a submarine, and any combination thereof.

18. The tether of claim 11 further comprising a terminal engagement device wherein the tether is connectable to the terminal engagement means to transfer at least one of communication, signals, data, and power to the marine load.

19. The tether of claim 11, wherein the variable buoyancy mechanism creates a non-linear contour in the tether to manage at least one of torsion, hockling, and motion forces exerted on the tether between the surface entity and the marine load.

* * * * *